US010184704B2

(12) United States Patent
Yokoyama et al.

(10) Patent No.: US 10,184,704 B2
(45) Date of Patent: Jan. 22, 2019

(54) EJECTOR AND EJECTOR-TYPE REFRIGERATION CYCLE

(71) Applicant: DENSO CORPORATION, Kariya, Aichi-pref. (JP)

(72) Inventors: Yoshiyuki Yokoyama, Kariya (JP); Haruyuki Nishijima, Kariya (JP); Yoshiaki Takano, Kariya (JP)

(73) Assignee: DENSO CORPORATION, Kariya, Aichi-Pref. (JP)

( * ) Notice: Subject to any disclaimer, the term of this patent is extended or adjusted under 35 U.S.C. 154(b) by 0 days.

(21) Appl. No.: 15/554,549

(22) PCT Filed: Feb. 26, 2016

(86) PCT No.: PCT/JP2016/001049
§ 371 (c)(1),
(2) Date: Aug. 30, 2017

(87) PCT Pub. No.: WO2016/143290
PCT Pub. Date: Sep. 15, 2016

(65) Prior Publication Data

US 2018/0058738 A1 Mar. 1, 2018

(30) Foreign Application Priority Data

Mar. 9, 2015 (JP) ..... 2015-045872

(51) Int. Cl.
*F04F 5/04* (2006.01)
*F25B 41/04* (2006.01)
(Continued)

(52) U.S. Cl.
CPC ..... *F25B 41/04* (2013.01); *F04F 5/04* (2013.01); *F04F 5/42* (2013.01); *F04F 5/44* (2013.01);
(Continued)

(58) Field of Classification Search
CPC ..... F25B 1/08; F25B 19/005; F25B 41/04; F04F 5/461; F04F 5/54; F04F 5/42; F04F 5/46
See application file for complete search history.

(56) References Cited

U.S. PATENT DOCUMENTS

2014/0020424 A1 1/2014 Suzuki et al.
2015/0023809 A1 1/2015 Yamada et al.
2015/0033790 A1 2/2015 Yamada et al.

FOREIGN PATENT DOCUMENTS

JP 2012202653 A 10/2012
JP 2013177879 A 9/2013
(Continued)

*Primary Examiner* — Ana M Vazquez
(74) *Attorney, Agent, or Firm* — Harness, Dickey & Pierce, P.L.C.

(57) ABSTRACT

An ejector includes a nozzle, a swirl flow generation portion, a body including a refrigerant suction port and a diffuser portion, a passage forming member, and an actuation device moving the passage forming member. A nozzle passage is defined between the nozzle and the passage forming member. A smallest passage cross-sectional area portion is provided in the nozzle passage. A swirl space that has a shape of a revolution and is coaxial with the nozzle, and a refrigerant inflow passage through which the refrigerant flows into the swirl space are defined in the swirl flow generation portion. The ejector further includes an area adjustment device that changes the passage cross-sectional area of the refrigerant inflow passage. According to this, an efficiency of energy conversion in the nozzle passage can be improved.

9 Claims, 12 Drawing Sheets

(51) Int. Cl.

| | |
|---|---|
| ***F04F 5/44*** | (2006.01) |
| ***F04F 5/48*** | (2006.01) |
| ***F04F 5/46*** | (2006.01) |
| ***F04F 5/54*** | (2006.01) |
| ***F04F 5/42*** | (2006.01) |
| ***F25B 1/08*** | (2006.01) |
| ***F25B 19/00*** | (2006.01) |

(52) U.S. Cl.
CPC ..... *F04F 5/46* (2013.01); *F04F 5/461* (2013.01); *F04F 5/48* (2013.01); *F04F 5/54* (2013.01); *F25B 1/08* (2013.01); *F25B 19/005* (2013.01)

(56) References Cited

FOREIGN PATENT DOCUMENTS

| | | | |
|---|---|---|---|
| JP | 2013185485 | A | 9/2013 |
| WO | WO-2016143300 | A1 | 9/2016 |

EJECTOR AND EJECTOR-TYPE REFRIGERATION CYCLE

CROSS REFERENCE TO RELATED APPLICATIONS

This application is a U.S. National Phase Application under 35 U.S.C. 371 of International Application No. PCT/JP2016/001049 filed on Feb. 26, 2016 and published in Japanese as WO 2016/143290 A1 on Sep. 15, 2016. This application is based on and claims the benefit of priority from Japanese Patent Application No. 2015-045872 filed on Mar. 9, 2015. The entire disclosures of all of the above applications are incorporated herein by reference.

TECHNICAL FIELD

The present disclosure relates to an ejector that draws a fluid by a drawing effect of a jetted fluid jetted at high velocity, and an ejector-type refrigeration cycle that includes the ejector.

BACKGROUND ART

Conventionally, Patent Document 1 discloses an ejector that draws a refrigerant through a refrigerant suction port by a drawing effect of a jetted refrigerant jetted at high velocity, the jetted refrigerant and the drawn refrigerant being mixed, a pressure of the mixed refrigerant being increased in the ejector. Patent Document 1 discloses an ejector-type refrigeration cycle that is a vapor-compression-type refrigeration cycle device including the ejector.

In the ejector of Patent Document 1, a passage forming member having a circular cone shape is provided in a body, and a refrigerant passage is defined between the body and a circular cone-shaped side surface of the passage forming member. A cross-sectional shape of the refrigerant passage is a circular annular shape. The most upstream part of the refrigerant passage is used as a nozzle passage through which a high-pressure refrigerant is decompressed and ejected, and the most downstream part of the refrigerant passage is used as a diffuser passage in which the jetted refrigerant and the drawn refrigerant are mixed, a pressure of the mixed refrigerant being increased in the diffuser passage.

Moreover a swirl space, which is a swirl flow generation portion generating a swirl flow in the refrigerant flowing into the nozzle passage, is defined in the body of the ejector of Patent Document 1. In the swirl space, the refrigerant on a swirl center side is decompressed and boiled by being swirled the subcooled liquid-phase refrigerant about a central axis of the nozzle, and a gas-phase refrigerant (air column) having a column shape is generated on the swirl center side. The two-phase separated refrigerant on the swirl center side flows into the nozzle passage.

According to this, in the ejector of Patent Document 1, boiling in the nozzle passage is enhanced, and an efficiency of energy conversion when converting a pressure energy to a kinetic energy in the nozzle passage is intended to be improved.

PRIOR ART DOCUMENT

Patent Document

Patent Document 1: JP No. 2013-177879 A

SUMMARY OF THE INVENTION

According to studies by the inventors, in the ejector of Patent Document 1, when a flow rate of the refrigerant circulating in the cycle is changed due to a fluctuation of a load of the ejector-type refrigeration cycle, the above-described improvement of the energy conversion efficiency may not be obtained.

The inventors have studied about the cause, and it is found that a shape of an air column shaped in the swirl space may be changed when the flow rate of the refrigerant in the ejector of Patent Document 1 is changed. When the shape of the air column is changed, it may be difficult that the refrigerant flows into the nozzle passage in a condition where the refrigerant is in a two-phase-separated state that is appropriate for improving the energy conversion efficiency.

In more detail, if the shape of the swirl space is set such that the refrigerant flowing into the nozzle passage is in the appropriate two-phase-separated state during a high-load operation in which the flow rate of the refrigerant is high, a velocity of a swirl decreases during a low-load operation in which the flow rate of the refrigerant is low, and accordingly the refrigerant may not be boiled due to a pressure decrease. Therefore, sufficient boiling cores may not be supplied to the refrigerant flowing through the nozzle passage.

In contrast, if the shape of the swirl space is set such that the refrigerant flowing into the nozzle passage is in the appropriate two-phase-separated state during a low-load operation, the velocity of the swirl during the high-load operation, and accordingly a radius of the air column may undesirably increase. Therefore, a pressure loss occurring when the refrigerant in the two-phase-separated state flows through the nozzle passage may be increased.

Accordingly, when the fluctuation of the load occurs in the ejector-type refrigeration cycle, the refrigerant may not flow into the nozzle passage in the appropriate two-phase-separated state, and accordingly high energy conversion efficiency may not be obtained by the ejector.

In consideration of the above-described points, it is an objective of the present disclosure to provide an ejector by which high energy conversion efficiency can be obtained regardless of a fluctuation of a load of a refrigeration cycle device.

Further, it is another objective of the present disclosure to provide an ejector-type refrigeration cycle that includes the ejector by which high energy conversion efficiency can be obtained regardless of the fluctuation of the load of a cycle.

The present disclosure is developed based on the analytic studies below. First, the inventors have examined about a flow of the refrigerant in an air column generated by swirling the refrigerant in a swirl space of an ejector of a prior art. The swirl space that is used in this study has the same shape as the conventional ejector.

As shown in FIG. 13, the swirl generated in a swirl space 60*a* is so called Rankine's combined vortex in which a free vortex and a forced vortex are combined. Therefore, a distribution of a velocity of the refrigerant in a radius direction in the swirl space 60*a* (a distribution in a cross-section taken in the axial direction of the swirl space 60*a*) varies as shown in FIG. 12.

Next, the inventors have looked the flow of the refrigerant in the cross-section of the swirl space 60*a* in the axial direction by a simulation analysis. FIG. 13 is a cross-sectional diagram of the swirl space 60*a* taken along the axial direction, and FIG. 13 illustrates a result of the analysis. As shown in FIG. 13, in the cross-section of the swirl space 60*a*, the air column has an approximately uniform radius. Moreover, it is confirmed that the liquid-phase refrigerant around the air column stays and circulates as shown in FIG. 13.

Therefore, the liquid-phase refrigerant, which flows into the swirl space 60*a* in the radial direction from a refrigerant inflow passage 60*b* and flows out from a smallest passage cross-sectional area portion 60*c*, flows along a wall surface that constitutes an outer peripheral side of the swirl space 60*a* as indicated by a solid arrow of FIG. 13.

In FIG. 13, an area of the liquid-phase refrigerant is indicated by a dot hatching for clear description, and the flows of the refrigerant in this area are indicated by arrows. The flows indicated by the arrows are flows that can be illustrated in FIG. 13, i.e. flows without a velocity component in a swirl direction.

There is a relationship below between a liquid-phase inflow refrigerant, which has just flowed into the swirl space 60*a* from the refrigerant inflow passage 60*b*, and a liquid-phase outflow refrigerant, which is flowing out from the smallest passage cross-sectional area portion 60*c*. In other words, a relationship represented by expression 1 is obtained from the law of conservation of energy.

$$P_0 + \frac{1}{2}\cdot\rho_0\cdot v_{\theta 0}^2 + \frac{1}{2}\cdot\rho_0\cdot v_{z0}^2 = P_{th} + \frac{1}{2}\cdot\rho_{th}\cdot v_{\theta th}^2 + \frac{1}{2}\cdot\rho_{th}\cdot v_{zth}^2 \quad \text{(expression 1)}$$

$P_0$ is a pressure of the liquid-phase inflow refrigerant, $\rho_0$ is a density of the liquid-phase inflow refrigerant, $v_{\theta 0}$ is a velocity of the liquid-phase inflow refrigerant in the swirl direction (swirl speed), and $v_{z0}$ is a velocity of the liquid-phase inflow refrigerant in the axial direction (velocity in the axial direction). $P_{th}$ is a pressure of the liquid-phase outflow refrigerant, $\rho_{th}$ is a density of the liquid-phase outflow refrigerant, $v_{\theta th}$ is a swirling speed of the liquid-phase outflow refrigerant, and $v_{zth}$ is a velocity of the liquid-phase outflow refrigerant in the axial direction. Since the liquid-phase refrigerant can be treated as an incompressible fluid, $\rho_0$ is equal to $\rho_{th}$. Therefore, the density of the liquid-phase refrigerant is described as $\rho$.

Expression 2 is obtained from the law of conservation of angular momentum.

$$\phi_0 = \phi_{th}\left(\frac{\phi_0 = R_0\cdot v_{\theta 0}}{\phi_{th} = (R_{th}-\delta)\cdot v_{\theta th}}\right) \quad \text{(expression 2)}$$

$\phi_0$ is the angular momentum of the liquid-phase inflow refrigerant, $R_0$ is a radius of the swirl of the liquid-phase outflow refrigerant on an outermost side, $\phi_{th}$ is the angular momentum of the liquid-phase outflow refrigerant, $R_{th}$ is a radius of the swirl of the liquid-phase outflow refrigerant on the outermost side, and $\delta$ is a thickness of the liquid-phase refrigerant at the smallest passage cross-sectional area portion 60*c* (thickness of a liquid layer). Accordingly, a radius $R_c$ of the air column can be represented by a difference between the radius $R_{th}$ of the swirl of the liquid-phase outflow refrigerant and the thickness $\delta$ of the liquid layer.

Expression 3 and expression 4 are obtained from the law of conservation of mass.

$$v_{z0} = \frac{\frac{G_{noz}}{\rho}}{\pi\cdot R_{in}^2} \quad \text{(expression 3)}$$

-continued $$v_{zth} = \frac{\frac{G_{noz}}{\rho}}{\pi\cdot\{R_{th}^2-(R_{th}-\delta)\}^2} \quad \text{(expression 4)}$$

$G_{noz}$ is a flow rate of the liquid-phase inflow refrigerant, and $R_{in}$ is a radius of an imaginary circle that has the same area as the passage cross-sectional area of the refrigerant inflow passage 60*b*.

An outermost part of the air column almost corresponds to an interface between the forced vortex and the free vortex described in FIG. 12, the forced vortex is generated in an inner area in which a gas-phase refrigerant exists, the free vortex is generated in an outer area in which the liquid-phase refrigerant exists. In the area where the free vortex is generated, the velocity is inversely proportional to the radius of the swirl, as understandable from expression 2.

When Bernoulli's equation is applied to the cross-section in the radial direction including the refrigerant inlet passage 60*b*, the pressure $P_c$ of the liquid-phase refrigerant on an interface between the gas and the liquid can be obtained as described in expression 5.

$$\tfrac{1}{2}\cdot\rho\cdot v_{\theta 0}^2 + P_0 = \tfrac{1}{2}\cdot\rho\cdot v_{\theta c}^2 + P_c \quad \text{(expression 5)}$$

In the area of the forced vortex, a change of the pressure is small compared to the area of the free vortex. Accordingly, the pressure in the air column almost corresponds to the pressure $P_c$ of the liquid-phase refrigerant on the interface between the gas and the liquid. When the pressure $P_c$ is equal to or smaller than a saturation pressure of the refrigerant regardless of the actuation of the load of the ejector-cycle refrigeration cycle, the air column is surely generated in the swirl space 60*a*.

The angular momentum of the liquid-phase refrigerant in the swirl space 60*a* which is necessary to calculate the pressure $P_c$ (pressure in the air column) is determined by the velocity $v_{\theta 0}$ of the liquid-phase inflow refrigerant in the swirl direction and the radius $R_0$ of the swirl of the liquid-phase inflow refrigerant, as shown in expression 2.

Accordingly, it is found that the air column providing the appropriate two-phase-separated refrigerant can be generated regardless of the fluctuation of the load of the ejector-type refrigeration cycle by setting parameters ($v_{\theta 0}$, $R_0$) to be adjustable according to the change of the load of the ejector-type refrigeration cycle or by limiting the parameters from being varied largely even when the load is changed.

An ejector according to a first aspect of the present disclosure is used in a vapor-compression type refrigeration cycle device and includes: a nozzle that ejects a refrigerant; and a swirl flow generation portion that generates a swirl flow about a central axis of the nozzle in the refrigerant flowing into the nozzle. The ejector includes a body including: a refrigerant suction port through which the refrigerant is drawn from an outside by a drawing effect of the ejected refrigerant ejected from the nozzle; and a diffuser portion in which the ejected refrigerant and the drawn refrigerant drawn through the refrigerant suction port are mixed, a pressure of the mixed refrigerant is increased in the pressure increasing portion. The ejector further includes: a passage forming member that is inserted into a refrigerant passage defined in the nozzle; and an actuation device that moves the passage forming member. The refrigerant passage defined between an inner peripheral surface of the nozzle and an outer peripheral surface of the passage forming member is a nozzle passage decompressing the refrigerant. The nozzle passage includes: a smallest passage cross-sectional area portion at which a passage cross-sectional area is decreased the most; a convergent portion that is located upstream of the smallest passage cross-sectional area portion with respect to a refrigerant flow, the passage cross-sectional area being gradually decreased in the smallest passage cross-sectional area portion; and a divergent portion located downstream of the smallest passage cross-sectional area portion with respect to the refrigerant flow, the passage cross-sectional area is gradually increased in the divergent portion. The swirl flow generation portion includes: a swirl space that has a shape of a solid of revolution and is coaxial with the central axis of the nozzle; and a refrigerant inflow passage through which the refrigerant having a velocity component in a swirl direction flows into the swirl space. The ejector further includes an area adjustment device that is configured to change a passage cross-sectional area of the refrigerant inflow passage.

According to this, since the swirl flow generation portion is provided, the refrigerant flowing into the nozzle passage can be in a two-phase-separated state where a gas-phase refrigerant disproportionately exists on a swirl center side. Boiling of the refrigerant flowing through the nozzle passage can be enhanced by using the gas-phase refrigerant on the center side as a boiling core. Accordingly, an efficiency of energy conversion from a pressure energy of the refrigerant to a kinetic energy in the nozzle passage can be improved.

Moreover, since the actuation device is provided, the passage cross-sectional area of the nozzle passage can be adjusted by moving the passage forming member according to a fluctuation of a load of the refrigeration cycle device. Accordingly, the ejector can be appropriately operated by changing the passage cross-sectional area at the smallest passage cross-sectional area portion according to a flow rate of the refrigerant circulating in the refrigeration cycle device.

Further, since the area adjustment device is provided, the passage cross-sectional area of the refrigerant inflow passage can be adjusted according to the fluctuation of the load of the refrigeration cycle device. Accordingly, a velocity of the refrigerant flowing into the swirl space from the refrigerant inflow passage in the swirl direction can be adjusted according to the fluctuation of the load of the refrigeration cycle device.

Consequently, an angular momentum of the refrigerant flowing into the swirl space from the refrigerant inflow passage can be appropriately adjusted, and the air column that causes the refrigerant flowing into the nozzle passage to be in the appropriate two-phase-separated state can be generated in the swirl space.

In other words, according to this aspect, the ejector by which high energy conversion efficiency can be obtained regardless of the fluctuation of the load of the refrigeration cycle device can be provided.

In the above-described ejector, the area adjustment device may enlarge the passage cross-sectional area of the refrigerant inflow passage according to an increase of the flow rate of the refrigerant flowing into the swirl space. The area adjustment device may enlarge the passage cross-sectional area of the refrigerant inflow passage according to an increase of a temperature of the refrigerant flowing into the swirl space.

An ejector according to a second aspect of the present disclosure is used in a vapor-compression type refrigeration cycle device and includes: a nozzle that ejects a refrigerant; and a swirl flow generation portion that generates a swirl flow about a central axis of the nozzle in the refrigerant flowing into the nozzle. The ejector includes a body including: a refrigerant suction port through which the refrigerant is drawn from an outside by a drawing effect of the ejected refrigerant ejected from the nozzle; and a diffuser portion in which the ejected refrigerant and the drawn refrigerant drawn through the refrigerant suction port are mixed, a pressure of the mixed refrigerant is increased in the pressure increasing portion. The ejector further includes: a passage forming member that is inserted into a refrigerant passage defined in the nozzle; and an actuation device that moves the passage forming member. The refrigerant passage defined between an inner peripheral surface of the nozzle and an outer peripheral surface of the passage forming member is a nozzle passage decompressing the refrigerant. The nozzle passage includes: a smallest passage cross-sectional area portion at which a passage cross-sectional area is decreased the most; a convergent portion that is located upstream of the smallest passage cross-sectional area portion with respect to a refrigerant flow, the passage cross-sectional area being gradually decreased in the smallest passage cross-sectional area portion; and a divergent portion located downstream of the smallest passage cross-sectional area portion with respect to the refrigerant flow, the passage cross-sectional area is gradually increased in the divergent portion. The swirl flow generation portion includes: a swirl space that has a shape of a solid of revolution and is coaxial with the central axis of the nozzle; and a refrigerant inflow passage through which the refrigerant having a velocity component in a swirl direction flows into the swirl space. $v_{in}$ is a velocity of the refrigerant flowing into the swirl space from the refrigerant inflow passage. $R_0$ is a radius of a swirl of the refrigerant flowing into the swirl space from the refrigerant inflow passage. $R_{th}$ is a radius of a swirl of the refrigerant at the smallest passage cross-sectional area portion. $\rho$ is a density of the refrigerant in liquid-phase. $\Delta P_{sat}$ is a pressure difference between a pressure of the refrigerant flowing into the refrigerant inflow passage and a saturation pressure at which the refrigerant is saturated when the refrigerant is decompressed isentropically, and $$\frac{R_0}{R_{th}} > \sqrt{\frac{2 \cdot \Delta P_{sat}}{\rho \cdot v_{in}^2} + 1}\,.$$

According to this, the swirl space can be provided, in which an appropriate air column can be generated within a range of a velocity of the refrigerant even when the velocity of the refrigerant flowing into the swirl space from the refrigerant inflow passage is changed due to the fluctuation of the load of the refrigeration cycle device, as described in the embodiments below.

An ejector-type refrigeration cycle according to a third aspect of the present embodiment includes the above-described ejector, and a radiator that cools a high-pressure refrigerant discharged from a compressor compressing the refrigerant, the high-pressure refrigerant is cooled to become a subcooled liquid-phase refrigerant in the radiator. The subcooled liquid-phase refrigerant flows into the swirl flow generation portion.

According to this, the ejector-type refrigeration cycle including the ejector by which high energy conversion efficiency can be obtained regardless of the fluctuation of the load of the cycle can be provided.

EMBODIMENTS FOR EXPLOITATION OF THE INVENTION

Figure 1:
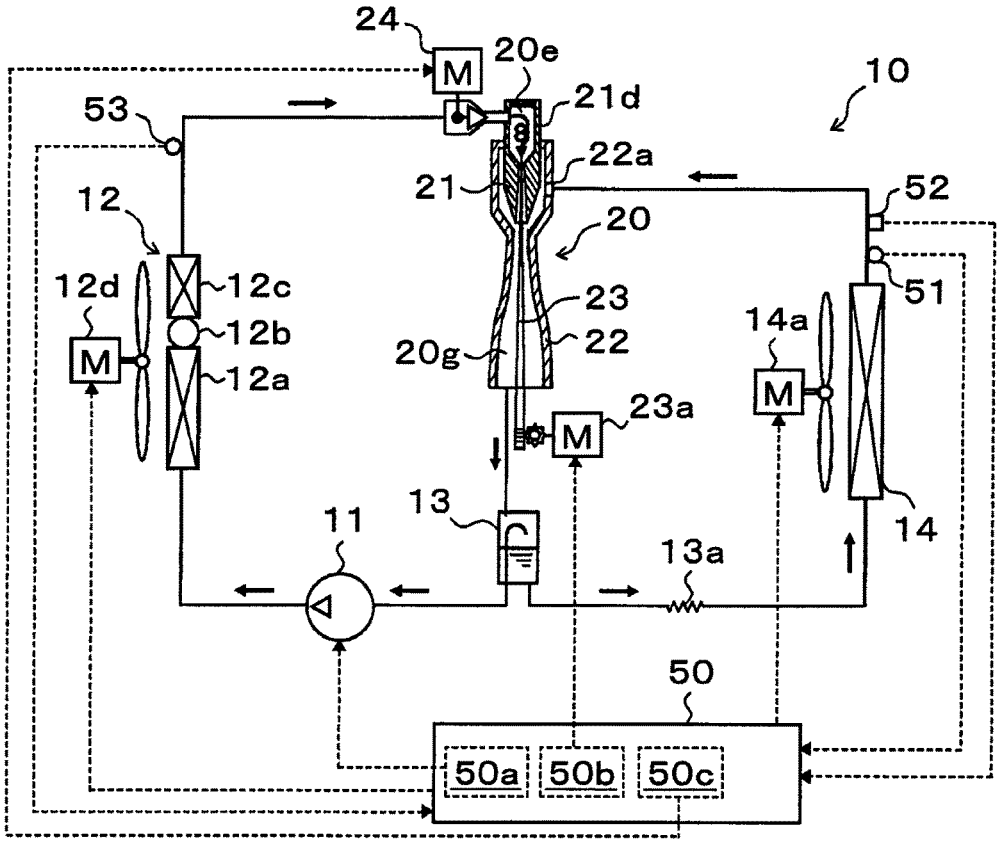
FIG. 1 is a diagram illustrating an entire structure of an ejector-type refrigeration cycle according to a first embodiment.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A first embodiment of the present disclosure will be described below referring FIGS. 1 to 4. An ejector 20 of the present embodiment is used in a vapor-compression-type refrigeration cycle device including the ejector, i.e. an ejector-type refrigeration cycle 10, as shown in FIG. 1 illustrating an entire structure. Moreover, the ejector-type refrigeration cycle 10 is used in a vehicular air conditioning device and cools a blown air sent to a vehicle compartment that is an air conditioning target space. Accordingly, a cooling target fluid of the ejector-type refrigeration cycle 10 of the present embodiment is the blown air.

Moreover, in the ejector-type refrigeration cycle 10 of the present embodiment, HFC refrigerant (specifically, R134a) is used, and the ejector-type refrigeration cycle 10 constitutes a subcritical refrigeration cycle in which a refrigerant pressure on a high-pressure side does not excess a critical pressure of the refrigerant. It is needless to say that HFO refrigerant (specifically, R1234yf) may be employed as the refrigerant. Moreover, a refrigeration oil that supplies lubrication to a compressor 11 is mixed to the refrigerant, and a part of the refrigeration oil circulates in the cycle together with the refrigerant.

In the ejector-type refrigeration cycle 10, the compressor 11 draws the refrigerant, increases a pressure of the refrigerant such that the refrigerant becomes a high-pressure refrigerant, and discharges the high-pressure refrigerant. Specifically, the compressor 11 of the present embodiment is an electric compressor that accommodates a fixed-capacity-type compression device and an electric motor driving the compression device in one housing.

A variety of compression devices such as a scroll-type compression device or a bane-type compression device can be used as the compression device. An actuation (a rotation speed) of the electric motor is controlled by a control signal outputted from an air conditioning control unit 50, and either an alternating-current motor or a direct-current motor can be used as the electric motor.

A refrigerant inlet side of a condensing portion 12*a* of a radiator 12 is connected to a discharge port of the compressor 11. The radiator 12 is a heat dissipation heat exchanger that dissipates heat from the high-pressure refrigerant to cool the high-pressure refrigerant by performing a heat exchange between the high-pressure refrigerant discharged from the compressor 11 and a vehicle outside air (outside air) blown by a cooling fan 12*d*.

More specifically, the radiator 12 is a so-called subcooling-type condenser including the condensing portion 12*a*, a receiver portion 12*b*, and a subcooling portion 12*c*. The condensing portion 12*a* dissipates the heat from the high-pressure gas-phase refrigerant to condense the high-pressure gas-phase refrigerant by performing the heat exchange between the high-pressure gas-phase refrigerant and the outside air blown by the cooling fan 12*d*. The receiver portion 12*b* separates the refrigerant flowing out of the condensing portion 12*a* into the gas-phase refrigerant and the liquid-phase refrigerant and accumulates a surplus liquid-phase refrigerant. The subcooling portion 12*c* performs heat exchange between the liquid-phase refrigerant flowing out of the receiver portion 12*b* and the outside air blown by the cooling fan 12*d* to subcool the liquid-phase refrigerant.

The cooling fan 12*d* is an electric blower whose rotation speed (the amount of blowing air) is controlled by a control voltage outputted from the air conditioning control unit 50.

A refrigerant inflow passage 21*a* of the ejector 20 is connected to a refrigerant outlet of the subcooling portion of the radiator 12. The ejector 20 works as a refrigerant decompression device that decompresses the high-pressure liquid-phase refrigerant in a subcooled state flowing out of the radiator 12 and ejects the refrigerant to a downstream side, and the ejector 20 works as a refrigerant circulation device (refrigerant sending device) that draws (send) the refrigerant flowing out of an evaporator by a drawing effect of a jetted refrigerant jetted at a high velocity and circulates the refrigerant.

Figure 2:
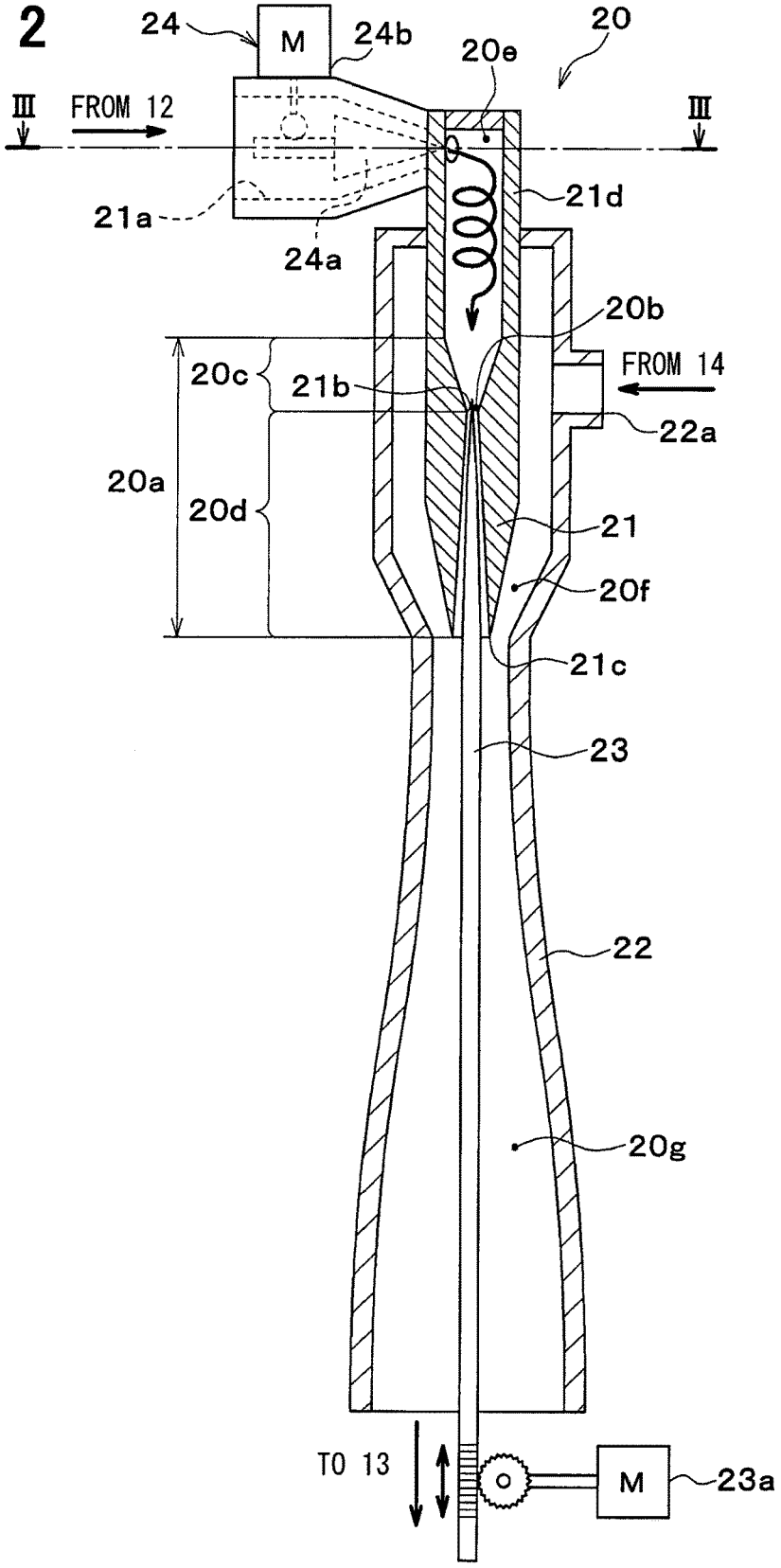
FIG. 2 is a cross-sectional diagram of an ejector taken along an axial direction according to the first embodiment.

A specific configuration of the ejector 20 will be described referring to FIGS. 2 and 3. The ejector 20 includes a nozzle 21, a body 22, a needle valve 23, and an inflow area adjusting valve 24, for example. The nozzle 21 is formed of metal (for example, stainless alloy) that has an approximately circular cylindrical shape gradually tapered toward a flow direction of the refrigerant, and the nozzle 21 jets the refrigerant after isentropically decompressing the refrigerant in a nozzle passage 20*a* defined in the nozzle 21.

In the nozzle 21, the needle valve 23 that has a needle shape that is a passage forming member is provided. The needle valve 23 will described later. The refrigerant passage defined between an inner peripheral surface of the nozzle 21 and an outer peripheral surface of the needle valve 23 defines at least a part of the nozzle passage 20*a* that decompresses the refrigerant. Accordingly, in an area where the nozzle 21 and the needle valve 23 overlap when viewed in a direction perpendicular to an axial direction of the nozzle 21, a cross-sectional shape of the nozzle passage 20*a* taken along the direction perpendicular to the axial direction is an annular shape.

On an inner peripheral surface of the nozzle 21, a throat portion 21*b* defining a smallest passage cross-sectional area portion 20*b* in which a sectional area of the refrigerant passage decreases the most is provided. Therefore, the nozzle passage 20*a* includes a convergent portion 20*c* on a refrigerant upstream side of the smallest passage cross-sectional area portion 20*b*, and a divergent portion 20*d* on a refrigerant downstream side of the smallest passage cross-sectional area portion 20*b*. In the convergent portion 20*c*, the sectional area of the refrigerant passage is gradually decreased toward the smallest passage cross-sectional area portion 20*b*. In the divergent portion 20*d*, the sectional area of the refrigerant passage is gradually enlarged.

In other words, the sectional area of the refrigerant passage in the nozzle passage 20*a* of the present embodiment changes similarly to a laval nozzle. Moreover, in the present embodiment, the refrigerant passage cross-sectional area of the nozzle passage 20*a* is changed such that the ejection refrigerant jetted from a refrigerant ejection port 21*c* is equal to or more than the sound speed during a normal operation of the ejector-type refrigeration cycle 10.

Furthermore, a cylinder portion 21*d* extending coaxially with an axis line of the nozzle 21 is provided upstream of a part defining the nozzle passage 20*a* of the nozzle 21. A swirl space 20*e* that swirls the refrigerant flowing into the nozzle 21 is provided inside the cylinder portion 21*d*. The swirl space 20*e* has an approximately circular column shape extending coaxially with the axis line of the nozzle 21.

A pipe is connected to an outer peripheral surface of an end portion of the cylinder portion 21*d* opposite from the nozzle passage 20*a*, the passage cross-sectional area of the pipe being tapered toward the refrigerant flow direction. The refrigerant inflow passage 21*a*, through which the refrigerant flows into the swirl space 20*e* from outside of the ejector 20, is provided in the pipe.

Figure 3:
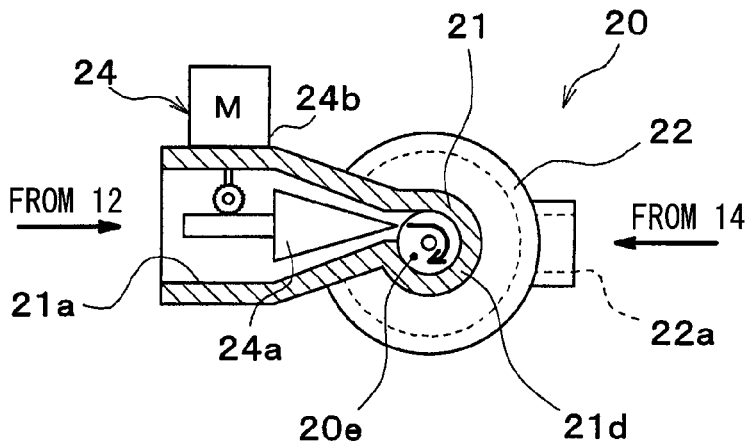
FIG. 3 is a cross-sectional diagram taken along II-III line of FIG. 2.

A central axis of the refrigerant inflow passage 21*a* extends in a tangential direction of an inner wall surface of the swirl space 20*e*, as shown in FIG. 3. According to this, the subcooled liquid-phase refrigerant flowing out of the radiator 12 and into the swirl space 20*e* through the refrigerant inflow passage 21*a* flows along the wall surface of the swirl space 20*e* and swirls about the central axis of the swirl space 20*e*. In other words, the refrigerant inflow passage 21*a* is connected to the swirl space 20*e* such that the refrigerant having a velocity component in a swirl direction flows into the swirl space 20*e*.

Since a centrifugal force is exerted on the refrigerant swirling in the swirl space 20*e*, a pressure of the refrigerant on a central axis side is lower than a pressure of the refrigerant on an outer peripheral side in the swirl space 20*e*. In the present embodiment, the refrigerant pressure on the center line side in the swirl space 20*e* is decreased to a pressure of a saturated liquid-phase refrigerant or a pressure at which the refrigerant is boiled due to a pressure decrease (a cavitation occurs) during a normal operation of the ejector-type refrigeration cycle 10.

Accordingly, in the present embodiment, the refrigerant inflow passage 21*a* and the cylinder portion 21*d* in the swirl space 20*e* constitute a swirl flow generating portion that swirls, around the axis of the nozzle 21, the subcooled liquid-phase refrigerant flowing into the nozzle 21. That is, in the present embodiment, the ejector 20 (specifically, nozzle 21) and the swirl flow generating portion are provided integrally with each other.

Moreover, the inflow area adjusting valve 24 is provided in the refrigerant inflow passage 21*a*. The inflow area adjusting valve 24 is an area adjustment device that adjusts a passage crow-sectional area of the refrigerant inflow passage 21*a* (specifically, the passage cross-sectional area at an outlet portion of the refrigerant inflow passage 21*a*).

The inflow area adjusting valve 24 includes a valve body 24*a* having an approximately circular cone shape and converging toward the swirl space 20*e*, and an electric actuator 24*b* including a stepper motor that moves the valve body 24*a* in an axial direction of the refrigerant inflow passage 21*a*. The electric actuator 24*b* is controlled by a control pulse outputted from the air conditioning control unit 50.

The body 22 is formed of metal (for example, aluminum) or resin shaped in an approximately circular cylinder shape, and the body 22 works as a fixation member that supports and fixes the nozzle 21 in an inside thereof and constitutes an outer body of the ejector 20. Specifically, the nozzle 21 is housed and fixed by press-fitting to one end of the body 22 in a longitudinal direction. Accordingly, the refrigerant is prevented from leaking through a fixation portion (press-fitting portion) of the nozzle 21 and the body 22.

A refrigerant suction port 22*a* extending through the body 22 is provided in a part of an outer peripheral surface of the body 22 which corresponds to an outer peripheral side of the nozzle 21. The refrigerant suction port 22*a* is communicated with the refrigerant ejection port 21*c* of the nozzle 21. The refrigerant suction port 22*a* is a through-hole through which the refrigerant flowing out of the evaporator 14 is drawn from the outside to the inside due to a drawing effect of the ejection refrigerant jetted from the nozzle 21.

A suction passage 20*f* and a diffuser portion 20*g* are provided in the body 22. The suction passage 20*f* guides the refrigerant drawn through the refrigerant suction port 22*a* to the refrigerant ejection port side of the nozzle 21. The diffuser portion 20*g* is a pressure increasing portion in which the refrigerant drawn through the refrigerant suction port 22*a* into the inside of the ejector 20 is mixed with the ejected refrigerant, a pressure of the mixed refrigerant being increased in the diffuser portion 20*g*.

The diffuser portion 20*g* is defined as a space that is positioned so as to continue to an outlet of the suction passage 20*f*. The refrigerant passage area is gradually enlarged in the space. According to this, the diffuser portion 20*g* performs a function for mixing the ejected refrigerant and the drawn refrigerant, decreasing the flow rate of the mixed refrigerant, and increasing the pressure of the mixed refrigerant of the ejected refrigerant and the drawn refrigerant. In other words, the diffuser portion 20*g* performs a function for converting a velocity energy of the mixed refrigerant to a pressure energy.

The needle valve 23 works as a passage forming member and changes the passage cross-sectional area of the nozzle passage 20*a*. Specifically, the needle valve 23 is made of resin and has a needle shape tapered from the diffuser portion 20*g* side toward the refrigerant upstream side (nozzle passage 20*a* side). The needle valve 23 may be made of metal.

Moreover, the needle valve 23 is located coaxially with the nozzle 21. An electric actuator 23*a* including a stepper motor as a driving device that moves the needle valve 23 in the axial direction of the nozzle 21 is connected to an end portion of the needle valve 23 on the diffuser portion 20*g* side. The actuation of the electric actuator 23*a* is controlled by a control pulse outputted from the air conditioning control unit 50.

An inlet side of a gas-liquid separator 13 is connected to a refrigerant outlet of the diffuser portion 20*g* of the ejector 20 as shown in FIG. 1. The gas-liquid separator 13 is a gas-liquid separation device that separates the refrigerant flowing out of the diffuser portion 20*g* of the ejector 20 into the gas-phase refrigerant and the liquid-phase refrigerant. In the present embodiment, a device having a relatively small capacity which causes the liquid-phase refrigerant to flow out from a liquid-phase refrigerant outlet without accumulating much liquid-phase refrigerant is used as the gas-liquid separator 13. However, a device that can function as an accumulator storing a surplus liquid-phase refrigerant in the cycle may be used as the gas-liquid separator 13.

A gas-phase refrigerant outlet of the gas-liquid separator 13 is connected to an inlet side of the compressor 11. In contrast, the liquid-phase refrigerant outlet of the gas-liquid separator 13 is connected to a refrigerant inlet side of the evaporator 14 through a fixed throttle 13*a* that is a decompression device. As the fixed throttle 13*a*, an orifice or a capillary tube can be employed, for example.

The evaporator 14 is a heat absorbing heat exchanger that causes the low-pressure refrigerant to evaporate and to perform heat absorbing effect by performing a heat exchange between the low-pressure refrigerant flowing therein and the blown air that is blown from the a blowing fan 14*a* toward the vehicle compartment. The blowing fan 14*a* is an electric blower whose rotation speed (an amount of the blown air) is controlled by a control voltage outputted from the air conditioning control unit 50. A refrigerant outlet of the evaporator 14 is connected to a refrigerant suction port 22*a* side of the ejector 20.

Next, a general configuration of an electric controller of the present embodiment will be described. The air conditioning control unit 50 is constituted by a microcomputer including CPU, ROM and RAM, for example, and its peripheral circuit. The air conditioning control unit 50 performs calculations and processing based on control programs stored in the ROM to control actuations of the above-described electric actuators 11, 12*d*, 14*a*, 23*a*, for example.

The air conditioning control unit 50 is connected to sensors for air conditioning control such as an inside air temperature sensor for detecting a vehicle interior temperature (interior temperature) $T_r$, an outside air temperature sensor for detecting the temperature of an outside air $T_{am}$, an insolation sensor for detecting the amount of insolation $A_s$ in the vehicle compartment, an evaporator outlet side temperature sensor (evaporator outlet side temperature detection device) 51 for detecting the temperature $T_e$ of the refrigerant on the outlet side of the evaporator 14 (evaporator outlet side temperature), an evaporator outlet side pressure sensor (evaporator outlet side pressure detection device) 52 for detecting the pressure $P_e$ of the refrigerant on the outlet side of the evaporator 14, a radiator outlet side temperature sensor (radiator outlet side temperature detection device) 53 for detecting the temperature (radiator outlet side temperature) $T_d$ of the refrigerant on the outlet side of the radiator 12, and an outlet side pressure sensor for detecting a pressure $P_d$ on the outlet side of the radiator 12, and detection values of the sensors are inputted to the air conditioning control unit 50.

Moreover, an input side of the air conditioning control unit 50 is connected to an operation panel, which is not shown, located close to an instrument panel in a front part of the vehicle compartment, and an operation signal of an operation switch provided in the operation panel is inputted to the air conditioning control unit 50. The operation switch provided in the operation panel includes an air conditioning actuation switch for requiring the air conditioning of the vehicle compartment, and a vehicle compartment temperature setting switch for setting a vehicle inside temperature $T_{set}$.

In the air conditioning control unit 50, control units that control actuations of various control target devices connected to the output side of the control unit are integrated with each other, and a part of the air conditioning control unit 50 (hardware and software) controlling respective control target device constitutes a control unit for respective control target device.

For example, in the present embodiment, a part controlling the actuation of the compressor 11 constitutes a discharge capacity control portion 50*a*, and a part controlling the actuation of electric actuator 23*a* of the needle valve 23 constitutes a valve opening degree control portion 50*b*, and a part controlling the actuation of the inflow area adjusting valve 24 constitutes an inflow area control portion 50*c*. It is needless to say that the control portions 50*a*, 50*b*, 50*c* may be provided as separate control units from the air conditioning control unit 50.

Next, actuations of the above-described configurations of the present embodiment will be described. In the vehicular air conditioning device of the present embodiment, when the air conditioning actuation switch of the operation panel is turned on (ON), the air conditioning control unit 50 executes an air conditioning control program that is preliminary stored.

In the air conditioning control program, the detection signals of the above-described sensors for air conditioning control and operation signals of the operation panel are read. A target blown air temperature TAO that is a target temperature of the air blown into the vehicle compartment is calculated based on the detection signals and the operation signals.

The target blown air temperature TAO is calculated based on an expression 6 below.

$$TAO=K_{set}\cdot T_{set}-K_r\cdot T_r-K_{am}\cdot T_{am}-K_s\cdot A_s+C \quad \text{(expression 6)}$$

$T_{set}$ is the vehicle inside temperature that is set by the temperature setting switch, $T_r$ is the inside temperature detected by the inside temperature sensor, $T_{am}$ is the outside temperature detected by the outside temperature sensor, and $A_s$ is the amount of the insolation detected by the insolation sensor. $K_{set}$, $K_r$, $K_{am}$, and $K_s$ are control gains, and C is a constant for correction.

Moreover, in the air conditioning control program, operation states of the control target devices connected to the output side of the control unit are decided based on the calculated target blown air temperature TAO and the detection signals of the sensors.

For example, the refrigerant discharge capacity of the compressor 11, i.e. the control signal outputted to the electric motor of the compressor 11, is decided as described below. First, a control map that is preliminary stored in a memory circuit is referred based on the target blown air temperature TAO, and then a target evaporator air temperature TEO of the blown air blown from the evaporator 14 is decided.

The control signal outputted to the electric motor of the compressor 11 is decided based on a deviation (TEO–$T_e$) between the evaporator outlet side temperature $T_e$ detected by the evaporator outlet side temperature sensor 51 and the target evaporator air temperature TEO such that the evaporator outlet side temperature $T_e$ becomes close to the target evaporator air temperature TEO by using a feedback control method.

Specifically, the discharge capacity control portion 50*a* of the present embodiment controls the refrigerant discharge capacity (rotation speed) of the compressor 11 such that the amount of the refrigerant circulating in the cycle increases according to increase of the deviation (TEO–$T_e$), i.e. increase of the thermal load of the ejector-type refrigeration cycle 10.

The control pulse outputted to the electric actuator 23*a* that moves the needle valve 23 is decided such that the degree of superheat SH of the refrigerant on the outlet side of the evaporator 14, which is calculated based on the evaporator outlet side temperature $T_e$ and the evaporator outlet side pressure $P_e$ detected by the evaporator outlet side pressure sensor 52, comes closer to a predetermined reference superheat degree $K_{SH}$.

Specifically, the valve opening degree control portion 50*b* of the present embodiment controls the actuation of the electric actuator 23*a* such that the passage cross-sectional area of the smallest passage cross-sectional area portion 20*b* is increased according to the increase of the degree of superheat SH of the refrigerant on the outlet side of the evaporator 14.

The control pulse outputted to the electric actuator 24*a* of the inflow area adjusting valve 24 is decided by referring a control map that is preliminary stored in the memory circuit based on the radiator outlet side temperature $T_d$ detected by the radiator outlet side temperature sensor 53. In this control map, a valve opening degree of the inflow area adjusting valve 24 increases according to an increase of the radiator outlet side temperature $T_d$.

Therefore, the inflow area control portion 50*c* of the present embodiment controls the inflow area adjusting valve 24 such that the passage cross-sectional area of the refrigerant inflow passage 21*a* increases according to an increase of a temperature of the refrigerant flowing into the swirl space 20*e*.

The radiator outlet side temperature $T_d$ increases according to an increase of the outlet temperature and the increase of the refrigerant discharge capacity of the compressor 11. Accordingly, the inflow area control portion 50*c* controls the actuation of the inflow area adjusting valve 24 such that the passage cross-sectional area of the refrigerant inflow passage 21*a* increases according to an increase of the thermal load of the cycle.

Moreover, the inflow area control portion 50*c* controls the actuation of the inflow area adjusting valve 24 such that the passage cross-sectional area of the refrigerant inflow passage 21*a* increases according to an increase of the amount of the refrigerant circulating in the cycle, i.e. an increase of the amount of the refrigerant flowing into the swirl space 20*e*.

The air conditioning control unit 50 outputs the decided control signals to corresponding control target devices. Subsequently, a control routine is repeated until a stop of the actuation of the vehicular air conditioning device is required, in which the above-described detection signals and operation signals are read, the target blown air temperature TAO is calculated, the actuation states of the control target devices are decided, and the control signals are outputted.

Therefore, in the ejector-type refrigeration cycle 10, the refrigerant flows as indicated by the thick and solid arrow of FIG. 1. The state of the refrigerant changes as shown in the Mollier diagram of FIG. 4.

In more detail, the high-temperature and high-pressure refrigerant (point a of FIG. 4) discharged from the compressor 11 flows into the condensing portion 12*a* of the radiator 12 and exchanges heat with the outside air blown by the cooling fan 12*d*, and the refrigerant dissipates heat to be condensed. The refrigerant condensed in the condensing portion 12*a* is separated into the gas-phase refrigerant and the liquid-phase refrigerant in the receiver portion 12*b*. The liquid-phase refrigerant separated in the receiver portion 12*b* exchanges heat, in the subcooling portion 12*c*, with the outside air blown by the cooling fan 12*d*, and the refrigerant further dissipates heat to become a subcooled liquid-phase refrigerant (from the point a to a point b of FIG. 4).

The subcooled liquid-phase refrigerant flowing out of the subcooling portion 12*c* of the radiator 12 flows into the swirl space 20*e* of the ejector 20. At this time, the inflow area control portion 50*c* controls the actuation of the inflow area adjusting valve 24 such that the passage cross-sectional area of the refrigerant inflow passage 21*a* increases according to the increase of the radiator outlet side temperature $T_d$.

Figure 4:
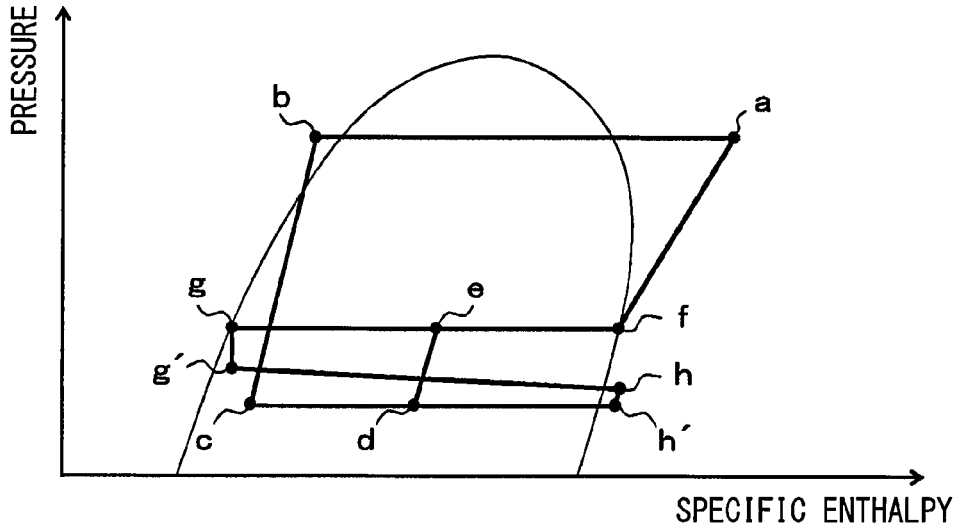
FIG. 4 is a Mollier diagram illustrating a change in a state of a refrigerant in the ejector-type refrigeration cycle according to the first embodiment.

The refrigerant flowing from the swirl space 20*e* of the ejector 20 into the nozzle passage 20*a* is isentropically reduced in the nozzle passage 20*a* and ejected (from the point b to a point c of FIG. 4). At this time, the valve opening degree control portion 50*b* controls the actuation of the electric actuator 23*a* such that the degree of superheat SH of the refrigerant on the outlet side of the evaporator 14 (point h of FIG. 4) comes close to the predetermined reference degree of superheat $K_{SH}$.

The refrigerant flowing out of the evaporator 14 (point h of FIG. 4) is drawn through the refrigerant suction port 22*a* by the suction effect of the ejected refrigerant jetted from the nozzle passage 20*a*. The ejected refrigerant jetted from the nozzle passage 20*a* and the drawn refrigerant drawn through the refrigerant suction port 22*a* flow into the diffuser portion 20*g* and join together (from the point c to a point d, and from a point h' to the point d of FIG. 4).

The suction passage 20*f* of the present embodiment is formed such that the passage cross-sectional area is gradually decreased in the refrigerant flow direction. Therefore, the pressure of the drawn refrigerant that passes the suction passage 20*f* decreases (from the point h to the point h' of FIG. 4), and the flow rate of the drawn refrigerant that passes the suction passage 20*f* increases. Accordingly, a difference in velocity between the drawn refrigerant and the ejected refrigerant, and an energy loss (mixing loss) when the drawn refrigerant and the ejected refrigerant are mixed in the diffuser portion 20*g* is decreased.

In the diffuser portion 20*g*, a kinetic energy of the refrigerant is converted into a pressure energy by an increase of the refrigerant passage cross-sectional area. Accordingly, a pressure of the mixed refrigerant is increased while the ejected refrigerant and the drawn refrigerant are mixed (from a point e to the point d of FIG. 4). The refrigerant flowing out of the diffuser portion 20*g* is separated in the gas-liquid separator 13 into the gas-phase refrigerant and the liquid-phase refrigerant (from the point e to a point f, and from the point e to a point g of FIG. 4).

The liquid-phase refrigerant separated in the gas-liquid separator 13 is decompressed by the fixed throttle 13*a* (from a point g' to the point g of FIG. 4) and flows into the evaporator 14. The refrigerant flowing into the evaporator 14 absorbs heat from the blown air blown by the blowing fan 14*a* and is evaporated (from the point h to the point g' of FIG. 4). According to this, the blown air is cooled. In contrast, the gas-phase refrigerant separated in the gas-liquid separator 13 is drawn into the compressor 11 and compressed again (from the point f to the point a of FIG. 4).

The ejector-type refrigeration cycle 10 of the present embodiment is actuated as described above and is capable of cooling the blown air blown to the vehicle compartment.

In the ejector-type refrigeration cycle 10 of the present embodiment, the refrigerant whose pressure is increased in the diffuser portion 20*g* of the ejector 20 is drawn into the compressor 11. Accordingly, the ejector-type refrigeration cycle 10 is capable of reducing power consumption of the compressor 11 to improve the coefficient of performance (COP) of the cycle compared to a conventional refrigeration cycle device in which a refrigerant evaporation pressure in an evaporator and a pressure of the refrigerant drawn to a compressor are almost the same.

Figure 13:
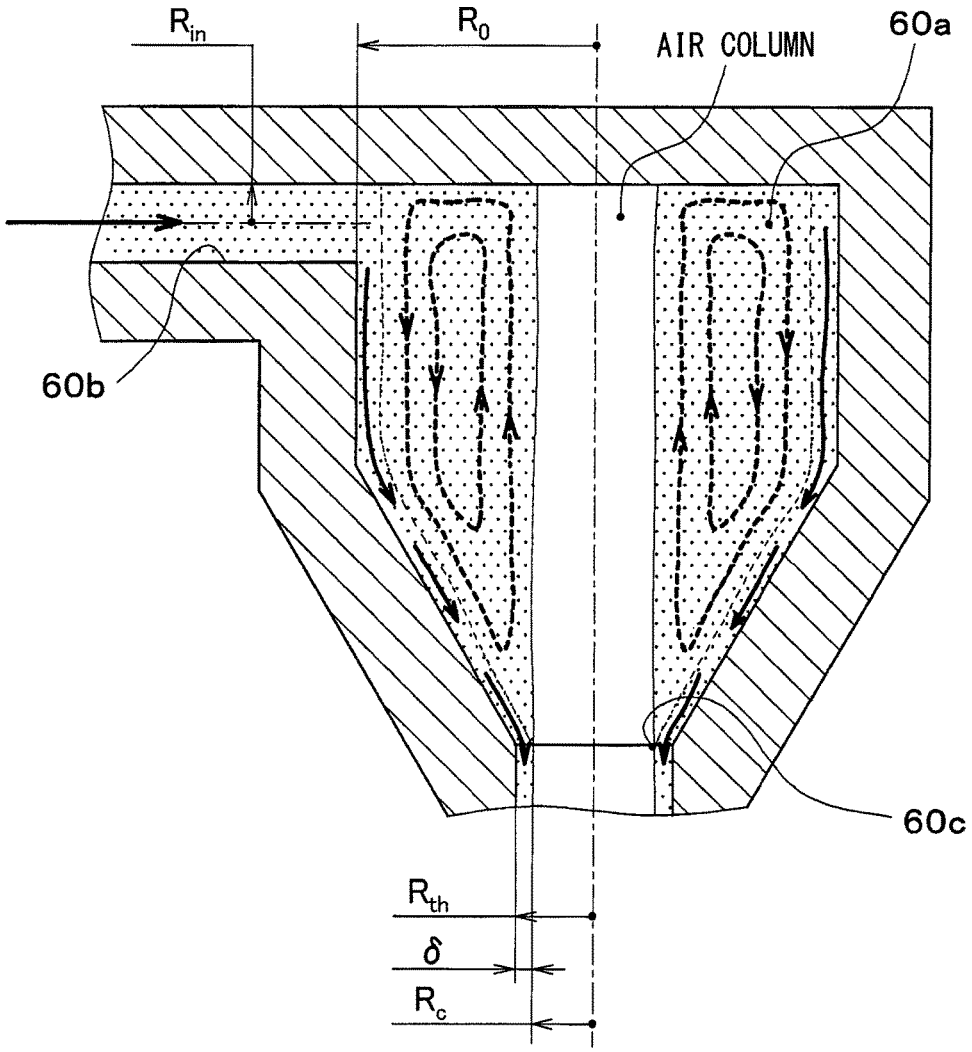
FIG. 13 PRIOR ART
FIG. 13 is an explanatory diagram for explaining a flow of a refrigerant in a swirl space of an ejector according to a prior art.

Moreover, according to the ejector 20 of the present embodiment, since the refrigerant is swirled in the swirl space 20*e*, the pressure of the refrigerant on a center side of the swirl in the swirl space 20*e* can be reduced such that the refrigerant becomes to be the saturated liquid-phase refrigerant or is to be boiled due to the pressure decrease (a cavitation occurs). According to this, since the gas-phase refrigerant having a column shape (air column) is provided on a swirl center side as shown in FIG. 13, the refrigerant becomes two-phase-separated state, in which the refrigerant around the central axis of the swirl in the swirl space 20*e* is a gas-single-phase refrigerant and the refrigerant around the gas-single-phase refrigerant is a liquid-single-phase refrigerant.

Since the refrigerant in the two-phase-separated state in the swirl space 20*e* flows into the nozzle passage 20*a*, boiling of the refrigerant is enhanced by a wall surface boiling, which occurs when the refrigerant is separated from the outer peripheral wall surface of the refrigerant passage having a circular annular shape, and an interface boiling, which is caused by a boiling core generated by the cavitation of the refrigerant on the central axis side of the refrigerant passage having a circular annular shape.

According to this, the refrigerant flowing into the smallest passage cross-sectional area portion 20*b* of the nozzle passage 20*a* becomes a gas-liquid mixed state in which the gas-phase refrigerant and the liquid-phase refrigerant are uniformly mixed. The flow of the refrigerant in the gas-liquid mixed state is throttled (choking) around the smallest passage cross-sectional area portion 20*b*, and the refrigerant in the gas-liquid mixed state achieving sound speed due to the choking is accelerated in and jetted from the divergent portion 20*d*.

Since the refrigerant in the gas-liquid mixed state can be effectively accelerated to achieve sound speed by the boiling enhancement due to both the wall surface boiling and the interface boiling, the efficiency of energy conversion in the nozzle passage 20*a* can be improved.

Since the ejector 20 of the present embodiment includes the needle valve 23 that is the passage forming member and the electric actuator 23*a* that is a driving device, the passage cross-sectional area of the smallest passage cross-sectional area portion 20*b* can be adjusted according to a change of the load of the ejector-type refrigeration cycle 10. Accordingly, the ejector 20 can be properly actuated according to the change of the load of the ejector-type refrigeration cycle 10.

In the configuration in which the air column is generated by swirling the refrigerant in the swirl space 20*e*, as in the ejector 20 of the present embodiment, the shape of the air column generated in the swirl space 20*e* is likely to change when the amount of the refrigerant flowing into the swirl space 20*e* changes due to the fluctuation of the load of the ejector-type refrigeration cycle 10.

Therefore, when the load of the ejector-type refrigeration cycle 10 is changed, the refrigerant may not flow into the nozzle passage 20*a* in a condition where the refrigerant is in the two-phase-separated state that is suitable for improving the efficiency of energy conversion in the nozzle passage 20*a*.

In contrast, since the ejector 20 of the present embodiment includes the inflow area adjusting valve 24 that is the area adjustment device 24, the passage cross-sectional area of the refrigerant inflow passage 21*a* can be adjusted according to the fluctuation of the load of the ejector-type refrigeration cycle 10. Accordingly, the velocity of the liquid-phase refrigerant flowing into the swirl space 20*e* from the refrigerant inflow passage 21*a* can be adjusted according to the fluctuation of the load of the ejector-type refrigeration cycle 10.

The shape of the air column can be adjusted by the angular momentum $\phi_0$ of the liquid-phase inflow refrigerant, as described referring to FIG. 13 and expression 2. The angular momentum $\phi_0$ is changed by the velocity $v_{\theta 0}$ in the swirl direction of the liquid-phase inflow refrigerant. Accordingly, since the ejector 20 of the present embodiment is capable of adjusting the velocity of the liquid-phase inflow refrigerant, the shape of the air column can be adjusted.

Moreover, in the present embodiment, the inflow area control portion 50*c* enlarges the passage cross-sectional area of the refrigerant inflow passage 21*a* according to the increase of the temperature of the liquid-phase refrigerant flowing into the swirl space 20*e*, i.e. the increase of the amount of the liquid-phase refrigerant flowing into the swirl space 20*e*. Accordingly, the velocity $v_{\theta 0}$ of the liquid-phase inflow refrigerant in the swirl direction can be maintained at approximately constant value without a large change, and a large change of the shape of the air column can be limited.

Consequently, according to the ejector 20 of the present embodiment, the ejector that is capable of achieving a high efficiency of energy conversion regardless of the fluctuation of the load of the ejector-type refrigeration cycle 10 can be provided.

Second Embodiment

Figure 5:
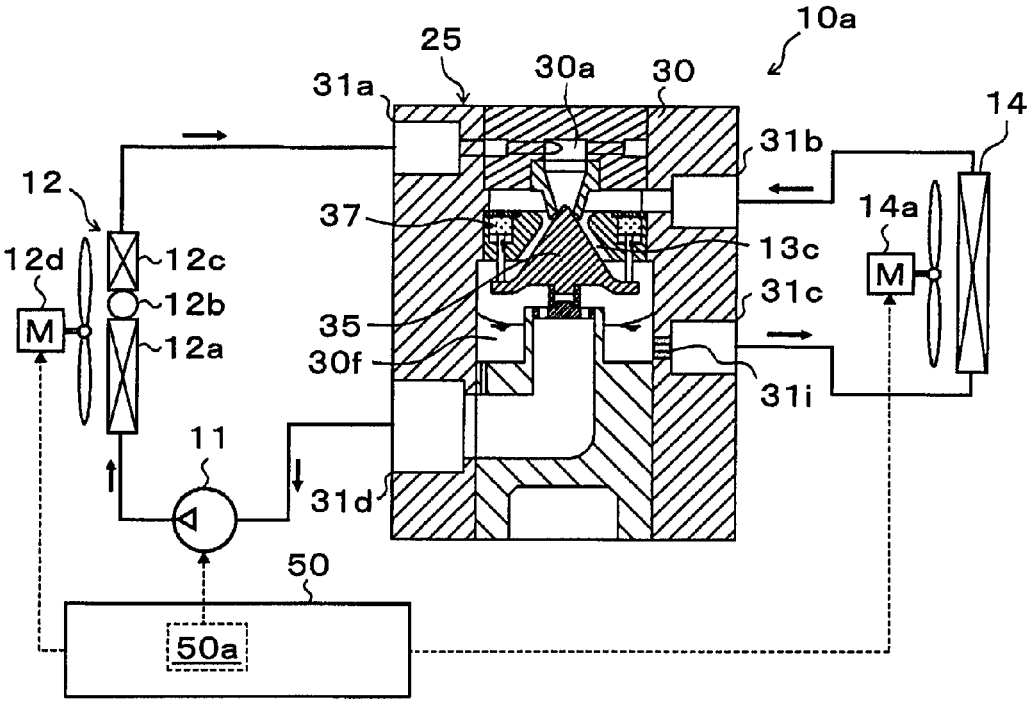
FIG. 5 is a diagram illustrating an entire structure of an ejector-type refrigeration cycle according to a second embodiment.

In the present embodiment, as compared with the first embodiment, an example of an ejector-type refrigeration cycle 10*a* will be described below, in which an ejector 25 is employed as shown in the overall configuration diagram of FIG. 5. In FIG. 5, a part that is the same as or equivalent to a matter described in the first embodiment may be assigned the same reference numeral. The same is applied to the following diagrams. In FIG. 5, sensors for air conditioning such as an evaporator outlet side temperature sensor 51 or an evaporator outlet side pressure sensor 52 are omitted for the sake of clarifying the drawing.

The ejector 25 of the present embodiment is a device in which configurations corresponding to the ejector 20, the gas-liquid separator 13, and the fixed throttle 13*a* described in the first embodiment are integrated (modularized) with each other. Accordingly, the ejector 25 may be referred to as "an ejector with gas-liquid separation function" or "an ejector module".

Specific configuration of the ejector 25 will be described below referring to FIGS. 6 to 8. An up-down arrow of FIG. 6 indicates an upward direction and a downward direction in a situation where the ejector 25 is installed in the ejector-type refrigeration cycle 10*a*, respectively.

Figure 6:
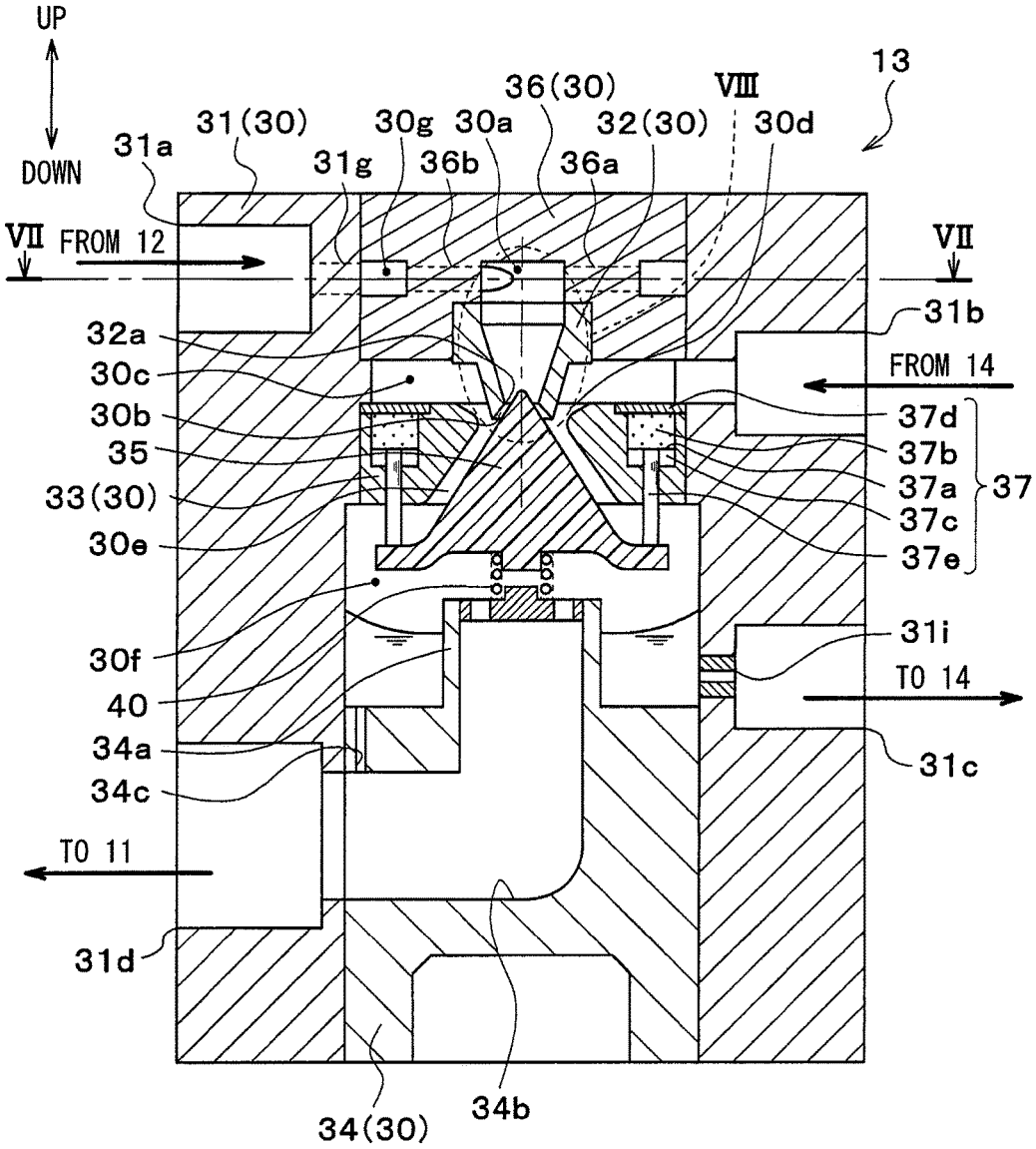
FIG. 6 is a cross-sectional diagram of an ejector taken along an axial direction according to the second embodiment.

The ejector 25 includes a body 30 that is formed by combining multiple components as shown in FIG. 6. Specifically, the body 30 includes a housing body 31 made of metal or resin having a prism or circular column shape, the housing body 31 forming an outer casing of the ejector 25. Moreover, a nozzle 32, a middle body 33, a lower body 34, and an upper cover 36 are fixed to the housing body 31, for example.

The housing body 31 includes: a refrigerant inlet 31*a* into which the refrigerant flowing out of a radiator 12 flows; a refrigerant suction port 31*b* through which the refrigerant flowing out of an evaporator 14 is drawn; a liquid-phase refrigerant outlet 31*c* through which the liquid-phase refrigerant separated in a gas-liquid separation space 30*f* defined in the body 30 flows out toward a refrigerant inlet side of the evaporator 14; and a gas-phase refrigerant outlet 31*d* through which the gas-phase refrigerant separated in the gas-liquid separation space 30*f* flows out toward an inlet side of a compressor 11, for example.

Moreover, in the present embodiment, an orifice 31*i* that is a decompression device decompressing the refrigerant flowing into the evaporator 14 is provided in a liquid-phase refrigerant passage through which the gas-liquid separation space 30*f* is communicated with the liquid-phase refrigerant outlet 31*c*. The gas-liquid separation space 30*f* of the present embodiment corresponds to the gas-liquid separator 13 described in the first embodiment, and the orifice 31*i* of the present embodiment corresponds to the fixed throttle 13*a* described in the first embodiment.

The upper cover 36 is made of metal or resin and has a circular cylinder shape, and an outer peripheral surface of the upper cover 36 is fixed, by press-fitting or screwing, to a fixation hole formed in an upper surface of the housing body 31. A nozzle 32 that is formed of a metal member, for example, having an approximately circular cone shape converging in the refrigerant flow direction is fixed to a lower side of the upper cover 36 by press-fitting, for example. The nozzle 32 will be described later.

A swirl space 30*a* that causes the refrigerant flowing through the refrigerant inlet 31*a* to swirl is defined in an upper side of the nozzle. The swirl space 30*a* is a space that has an approximately circular column shape extending coaxially with an axial direction of the upper cover 36 and nozzle 32, similarly to the swirl space 20*e* of the first embodiment.

A groove portion that is recessed to an inner peripheral side is provided on a cylindrical side surface of the upper cover 36. A cross-sectional shape of the groove portion has a rectangular shape. In detail, the groove portion has a Landolt ring shape (C-shape) along the outer periphery of the upper cover when viewed in the axial direction of the upper cover 36. Accordingly, when the upper cover 36 is fixed to the housing body 31, a distribution space 30*g* is defined between the groove portion and an inner peripheral surface of the housing body 31, as shown in FIG. 7.

A distribution refrigerant passage 31*g* that provides a communication between the refrigerant inlet 31*a* and the distribution space 30*g* is defined in the housing body 31. The upper cover 36 includes multiple (two, in the present embodiment) passages, i.e. a first refrigerant inflow passage 36*a* and a second refrigerant inflow passage 36*b*, which provide a communication between the distribution space 30*g* and the swirl space 30*a*.

Both the first refrigerant inflow passage 36*a* and the second refrigerant inflow passage 36*b* extend in a tangential direction of an inner peripheral wall surface of a part of the upper cover 36 and the nozzle 32 defining the swirl space 30*a*, when viewed in a central axis direction of the swirl space 30*a*.

According to this, the refrigerant flowing into the swirl space 30*a* from the distribution space 30*g* through the first refrigerant inflow passage 36*a* and the second refrigerant inflow passage 36*b* flows along a wall surface of the swirl space 30*a* and swirls about the central axis of the swirl space 30*a*. That is, the first refrigerant inflow passage 36*a* and the second refrigerant inflow passage 36*b* are formed such that the refrigerant having a velocity component in a swirl direction flows into the swirl space 30*a*.

In the swirl space 30*a* of the present embodiment, a refrigerant pressure on the center line side in the swirl space 30*a* is decreased to a pressure of a saturated liquid-phase refrigerant or a pressure at which the refrigerant is boiled due to a pressure decrease (a cavitation occurs) during a normal operation of the ejector-type refrigeration cycle 10, similarly to the first embodiment.

Accordingly, in the present embodiment, the first refrigerant inflow passage 36*a*, the second refrigerant inflow passage 36*b*, and the swirl space 30*a* constitute a swirl flow generation portion that swirls the subcooled liquid-phase refrigerant flowing into the nozzle 32 about the axis of the nozzle 32. In the present embodiment, the ejector 25 (specifically, body 30) and the swirl flow generation portion are integrated with each other.

Refrigerant inlets of the first refrigerant inflow passage 36*a* and the second refrigerant inlet 36*b* formed on a distribution space 30*g* side are open at regular intervals (180° in the present embodiment) when viewed in the central axis direction of the swirl space 30*a*. Accordingly, in the present embodiment, the refrigerant flowing into the distribution space 30*g* from the distribution refrigerant passage 31*g* reaches the refrigerant inlet of the first refrigerant inflow passage 36*a* first, and subsequently, the refrigerant reaches the refrigerant inlet of the second refrigerant inflow passage 36*b*.

A thermostat valve 38 is provided between the refrigerant inlet of the first refrigerant inflow passage 36*a* and the refrigerant inlet of the second refrigerant inflow passage 36*b* in the distribution space 30*g*. The thermostat valve 38 is a thermostatic valve that moves a valve body by a thermowax (thermostatic component) whose volume is changed by a temperature of the refrigerant flowing into the distribution space 30*g*.

Specifically, the thermostat valve 38 moves the valve body so as to partition the distribution space 30*g* into two spaces when the temperature of the refrigerant flowing into the distribution space 30*g* is equal to or smaller than a predetermined reference temperature.

Figure 7:
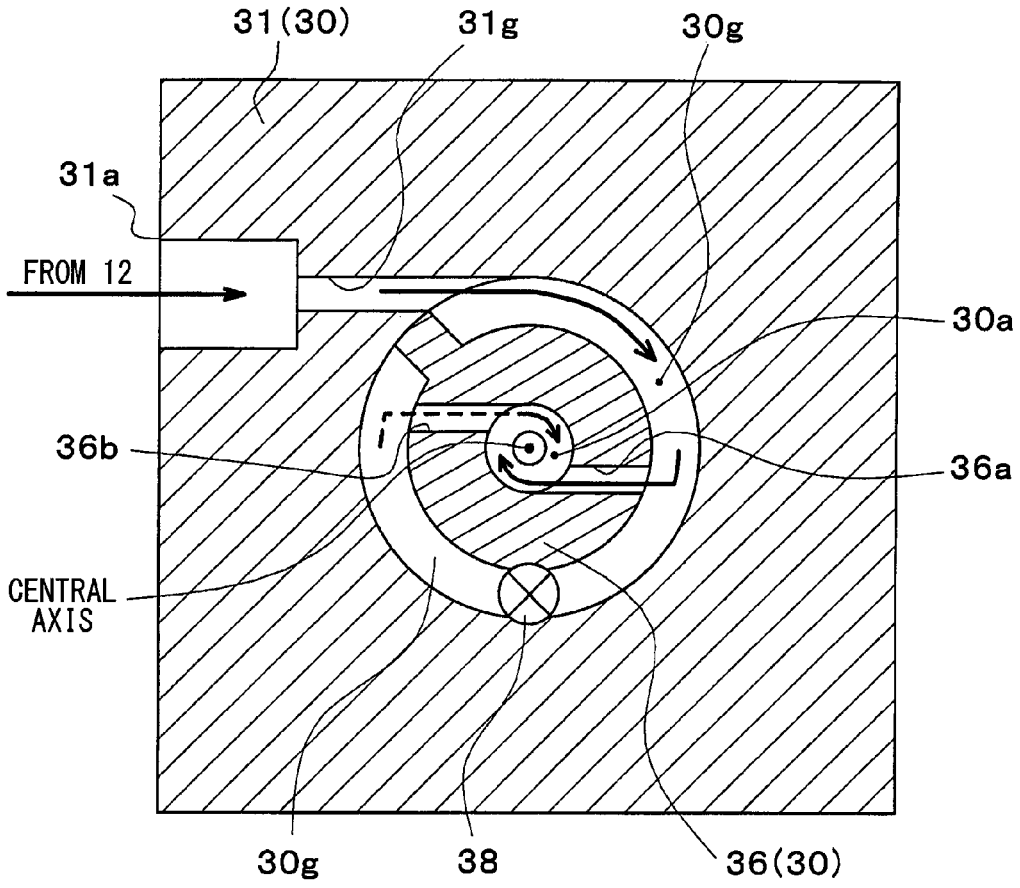
FIG. 7 is a schematic cross-sectional diagram of the ejector taken along a VII-VII line of FIG. 6.

Accordingly, in the present embodiment, when the temperature of the refrigerant flowing into the distribution space 30*g* is equal to or lower than the reference temperature, an inlet side of the second refrigerant inflow passage 36*b* is closed, and the distribution space 30*g* and the swirl space 30*a* are communicated with each other through the first refrigerant inflow passage 36*a*, as indicated by a solid arrow of FIG. 7.

When the temperature of the refrigerant flowing into the distribution space 30*g* is higher than the reference temperature, the distribution space 30*g* and the swirl space 30*a* are communicated with each other through both the first refrigerant inflow passage 36*a* and the second refrigerant inflow passage 36*b*, as indicated by the solid arrow and a dashed arrow of FIG. 7.

Therefore, the thermostat valve 38 of the present embodiment works as an opening-closing device that is configured to close at least some of multiple refrigerant inflow passages (36*a*, 36*b*). Moreover, the thermostat valve 38 constitutes an area adjustment device that enlarges the sum of the passage cross-sectional area of the first refrigerant inflow passage 36*a* and the second refrigerant inflow passage 36*b* according to the increase of the temperature of the refrigerant flowing into the swirl space 30*a*.

As shown in FIG. 6, a decompression space 30*b*, which decompresses the refrigerant flowing out of the swirl space 30*a* and flows the refrigerant to a downstream side, is defined in the nozzle 32. The decompression space 30*b* has a shape of a solid of revolution in which a circular column space and a conical frustum space continuing from a lower side of the circular column space and gradually diverging in the refrigerant flow direction are joined with each other. A center axis of the decompression space 30*b* is coaxial with the center axis of the swirl space 30*a*.

A passage forming member 35 is provided in the decompression space 30*b*. The passage forming member 35 performs the same function of the needle valve 23 described in the first embodiment. Specifically, the passage forming member 35 is made of resin and has a circular cone shape whose sectional area is increased according to a distance from the decompression space 30*b*. A central axis of the passage forming member 35 is coaxial with the central axis of the decompression space 30*b*.

Figure 8:
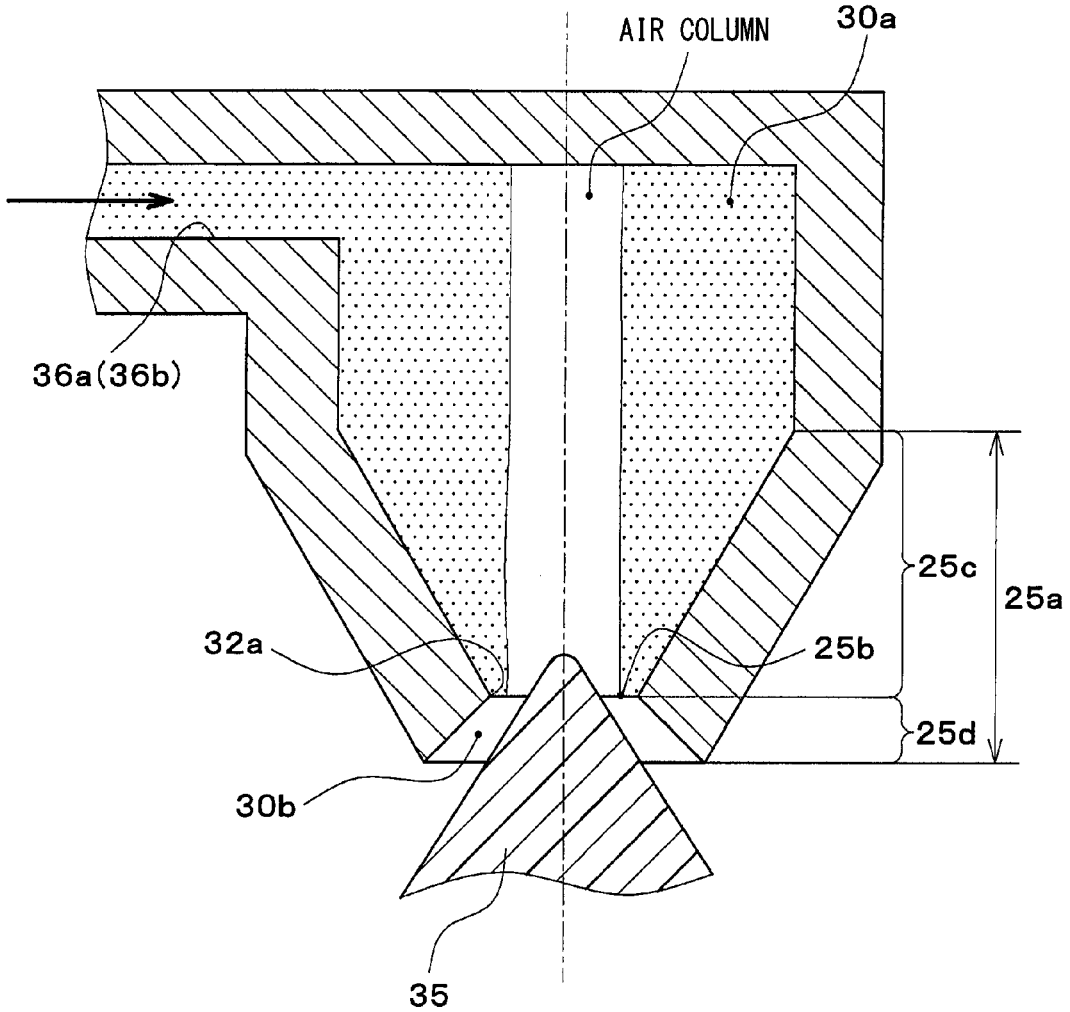
FIG. 8 is a cross-sectional diagram illustrating a VIII part of FIG. 6 enlarged in a schematic way.

According to this, at least a part of a nozzle passage 25*a*, whose cross-section is a circular annular shape, for decompressing the refrigerant is defined between an inner peripheral surface of a part of the nozzle 32 defining the decompression space 30*b* and an outer peripheral surface of the passage forming member 35, as shown in FIG. 8.

Moreover, a throat portion 32*a* defining a smallest passage cross-sectional area portion 25*b*, in which the refrigerant passage cross-sectional area is decreased the most, is provided on an inner wall surface of the nozzle 32. Therefore, the nozzle passage 25*a* includes a convergent portion 25*c* on a refrigerant upstream side of the smallest passage cross-sectional area portion 25*b*, and a divergent portion 25*d* on a refrigerant downstream side of the smallest passage cross-sectional area portion 25*b*. In the convergent portion 25*c*, the sectional area of the refrigerant passage is gradually decreased toward the smallest passage cross-sectional area portion 25*b*. In the divergent portion 25*d*, the sectional area of the refrigerant passage is gradually enlarged.

Accordingly, the refrigerant passage cross-sectional area of the nozzle passage 25*a* of the present embodiment also changes similarly to a laval nozzle. Moreover, in the present embodiment, the refrigerant passage cross-sectional area of the nozzle passage 25*a* is changed such that an ejected refrigerant jetted from the nozzle passage 25*a* is equal to or more than the sound speed during a normal operation of the ejector-type refrigeration cycle 10*a*.

Next, the middle body 33 shown in FIG. 6 is a circular metal board member that includes a through-hole extending through the two sides (from an upper side to a lower side) of the middle body 33 at a center portion. Moreover, an actuation mechanism 37 moving the passage forming member 35 is provided on an outer peripheral side of the through-hole of the middle body 33. The middle body 33 is fixed to a part of the inside of the housing body 31 positioned below the nozzle 32 by press-fitting, for example.

A flow-in space 30*c* in which the refrigerant flowing through the refrigerant suction port 31*b* is accumulated is defined between an upper surface of the middle body 33 and an inner wall surface of the housing body 31. Moreover, an suction passage 30*d* through which the flow-in space 30*c* and a refrigerant downstream side of the decompression space 30*b* are communicated with each other is defined between an inner peripheral surface of the through-hole of the middle body 33 and an outer peripheral surface of a lower part of the nozzle 32.

A pressure increasing space 30*e* that has an approximately conical frustum shape gradually enlarged in the refrigerant flow direction is provided on a refrigerant downstream side of the through-hole of the suction passage 30*d* of the middle body 33. The pressure increasing space 30*e* is a space in which the ejected refrigerant jetted from the above-described nozzle passage 25*a* and the drawn refrigerant drawn through the suction passage 30*d* are mixed. A central axis of the pressure increasing space 30*e* is coaxial with the center axes of the swirl space 30*a* and the decompression space 30*b*.

A lower part of the passage forming member 35 is positioned in the pressure increasing space 30*e*. A refrigerant passage defined between an inner peripheral surface of a part of the middle body 33 defining the pressure increasing space 30*e* and a lower part of an outer peripheral surface of the passage forming member 35 has a shape whose sectional area is gradually increased toward the refrigerant downstream side. According to this, the refrigerant passage is capable of converting the velocity energy of the mixed refrigerant of the ejected refrigerant and the drawn refrigerant into the pressure energy.

Accordingly, the refrigerant passage defined between the inner peripheral surface of the middle body 33 defining the pressure increasing space 30*e* and the lower part of the outer peripheral surface of the passage forming member 35 constitutes a diffuser passage that works as a diffuser (pressure increasing portion) in which the ejected refrigerant and the drawn refrigerant are mixed and the pressure of the mixed refrigerant is increased.

Next, the actuation mechanism 37 located inside the middle body 33 will be described. The actuation mechanism 37 includes a diaphragm 37*a* that is a pressure moved member having a circular thin plate shape. Specifically, the diaphragm 37*a* is fixed by welding, for example, so as to partition a circular column space defined on the outer peripheral side of the middle body 33 into an upper space and a lower space, as shown in FIG. 6.

The upper (flow-in space 30*c* side) space of the two spaces partitioned by the diaphragm 37*a* constitutes an enclosure space 37*b* in which a thermostatic medium whose pressure changes according to a temperature of the refrigerant on the outlet side of the evaporator 14 (specifically, the refrigerant flowing out of the evaporator 14). The thermostatic medium whose primary component is the refrigerant circulating in the ejector-type refrigeration cycle 10*a* is enclosed in the enclosure space 37*b* so as to have a predetermined density.

In contrast, the lower space of the two spaces partitioned by the diaphragm 37*a* constitutes an introduction space 37*c* into which the refrigerant on the outlet side of the evaporator 14 is introduced through a communication passage that is not shown. Accordingly, the temperature of the refrigerant on the outlet side of the evaporator 14 is transferred to the thermostatic medium enclosed in the enclosure space 37*c* through the diaphragm 37*a* and a lid member 37*d* that separates the flow-in space 30*c* from the enclosure space 37*b*.

Moreover, the diaphragm 37*a* changes its shape according to a difference between an internal pressure of the enclosure space 37*b* and a pressure of the refrigerant on the outlet side of the evaporator 14 flowing into the introduction space 37*c*. Therefore, the diaphragm 37*a* is preferred to be made of a material that has high elasticity, high thermal conductivity, and high strength. Specifically, a thin metal plate made of stainless (SUS 304) or EPDM (ethylene propylene diene monomer rubber) including a ground fabric may be used as the diaphragm.

At a center part of the diaphragm 37*a*, one end side end portion (upper side end portion) of an actuation bar 37*e* having a circular column shape is bonded. The actuation bar 37*e* transfers an actuation force from the actuation mechanism 37 to the passage forming member 35 to move the passage forming member 35. The other end side end portion (lower side end portion) of the actuation bar 37*e* is located to be in contact with an outer peripheral side of a bottom surface of the passage forming member 35.

As shown in FIG. 6, the bottom surface of the passage forming member 35 receives a stress from a coil spring 40. The coil spring 40 is an elastic member that exerts the stress urging the passage forming member 35 toward an upper side (a direction in which the passage forming member 35 decreases the passage cross-sectional area at the smallest passage cross-sectional area portion 25*b*). Accordingly, the passage forming member 35 is moved such that a stress exerted by the high-pressure refrigerant on the swirl space 30*a* side, a stress exerted by the low-pressure refrigerant on the gas-liquid separation space 30*f* side, a stress exerted by the actuation bar 37*e*, and the stress exerted by the coil spring 40 are balanced.

Specifically, when the temperature (degree of superheat) of the refrigerant on the outlet side of the evaporator 14 increases, a saturation pressure of the thermostatic medium enclosed in the enclosure space 37*b* increases, and accordingly the difference between the internal pressure of the enclosure space 37*b* and the pressure of the introduction space 37*c* becomes large. According to this, the diaphragm 37*a* is moved toward the introduction space 37*c* side, and the pressure exerted on the passage forming member 35 by the actuation bar 37*e* increases. Therefore, when the temperature of the refrigerant on the outlet side of the evaporator 14 increases, the passage forming member 35 moves in a direction (downward in the vertical direction) in which the passage cross-sectional area at the smallest passage cross-sectional area portion 25*b* increases.

In contrast, when the temperature (degree of superheat) of the refrigerant on the outlet side of the evaporator 14 decreases, the saturation pressure of the thermostatic medium enclosed in the enclosure space 37*b* decreases, and accordingly the difference between the internal pressure of the enclosure space 37*b* and the pressure of the introduction space 37*c* decreases. According to this, the diaphragm 37*a* moves toward the enclosure space 37*b* side, and the stress exerted on the passage forming member 35 by the actuation bar 37*e* decreases. Therefore, when the temperature of the refrigerant on the outlet side of the evaporator 14 decreases, the passage forming member 35 moves in a direction (upward in the vertical direction) in which the passage cross-sectional area of the smallest passage cross-sectional area portion 25*b* decreases.

In the actuation mechanism 37 of the present embodiment, since the diaphragm 37*a* moves the passage forming member 35 according to the degree of superheat of the refrigerant on the outlet side of the evaporator 14, the passage cross-sectional area at the smallest passage cross-sectional area portion 25*b* is adjusted such that a degree of superheat of the refrigerant on the outlet side of the evaporator 14 comes close to a predetermined reference superheat degree $K_{SH}$. The reference superheat degree $K_{SH}$ can be changed by adjusting the stress exerted by the coil spring 40.

A gap between the actuation bar 37*e* and the middle body 33 is sealed by a seal member such as O-ring that is not shown, and accordingly the refrigerant does not leak through the gap even when the actuation bar 37*e* moves.

In the present embodiment, multiple (three in the present embodiment) spaces having circular column shape are formed in the middle body 33, and the diaphragm 37*a* having the circular thin plate shape is fixed in each of the spaces to constitute multiple actuation mechanisms 37. Moreover, multiple actuation mechanisms 37 are arranged with regular intervals about the central axis so as to uniformly transfer the actuation force to the passage forming member 35.

Next, the lower body 34 is formed of a metal material having a circular column shape and fixed in the housing body 31 by screwing, for example, so as to close a bottom surface of the housing body 31. The gas-liquid separation space 30*f* that separates the refrigerant flowing out of the diffuser passage defined in the pressure increasing space 30*e* is defined between an upper side of the lower body 34 and the middle body 33.

The gas-liquid separation space 30*f* has a shape of solid of revolution that is approximately circular column shape, and the central axis of the gas-liquid separation space 30*f* is coaxial with the center axes of the swirl space 30*a*, the decompression space 30*b*, and the pressure increasing space 30*e*, for example. In the gas-liquid separation space 30*f*, the refrigerant is separated into the gas-phase refrigerant and the liquid-phase refrigerant by a centrifugal force generated when the refrigerant swirls about the central axis. Moreover, a capacity of the gas-liquid separation space 30*f* is set such that a surplus refrigerant cannot be accumulated substantially even when the amount of the refrigerant circulating in the cycle varies due to a change of load of the cycle.

At a center part of the lower body 34, a pipe 34*a* extending toward the upper side and having a circular cylinder shape is provided coaxially with the gas-liquid separation space 30*f*. The liquid-phase refrigerant separated in the gas-liquid separation space 30*f* is temporarily accumulated on an outer peripheral side of the pipe 34*a* and flows through the liquid-phase refrigerant outlet 31*c*. In the pipe 34*a*, a gas-phase refrigerant outlet passage 34*b* through which the gas-phase refrigerant separated in the gas-liquid separation space 30*f* is guided to the gas-phase refrigerant outlet 31*d* of the housing body 31 is provided.

The above-described coil spring 40 is fixed on an upper end portion of the pipe 34*a*. The coil spring 40 works as a vibration absorbing member that reduces a vibration of the passage forming member 35 due to a pulse of the pressure generated when the refrigerant is decompressed. Moreover, an oil return hole 34*c* through which a refrigeration oil is returned to the compressor 11 through the gas-phase refrigerant outlet passage 34*b* is formed in the bottom surface of the gas-liquid separation space 30*f*.

Accordingly, the ejector 25 of the present embodiment includes: the swirl space 30*a* generating a swirl flow in the refrigerant flowing through the refrigerant inlet 31*a*; the decompression space 30*b* decompressing the refrigerant flowing out of the swirl space 30*a*; the passage for drawing the refrigerant 30*c*, 30*d* communicating with the refrigerant downstream side of the decompression space 30*b* to flow the refrigerant drawn from outside; and the body 30 including the pressure increasing space 30*e* in which the ejected refrigerant jetted from the decompression space 30*b* and the drawn refrigerant drawn through the passage for drawing 30*c*, 30*d* are mixed. The ejector 25 includes: the passage forming member 35 at least a part of which is located in the decompression space 30*b* and the pressure increasing space 30*e*, the passage forming member 35 having a circular cone shape in which the cross-sectional area increases from the decompression space 30*b*; and the actuation device 37 that outputs a driving force moving the passage forming member 35. The refrigerant passage defined between the inner peripheral surface of a part of the body 30 defining the decompression space 30*b* and the outer peripheral surface of the passage forming member 35 is the nozzle passage 25*a* that works as a nozzle from which the refrigerant flowing through the refrigerant inlet 31*a* is decompressed and jetted. The refrigerant passage defined between the inner peripheral surface of the body 30 defining the pressure increasing space 30*e* and the outer peripheral surface of the passage forming member 35 is the diffuser passage that works as the pressure increasing portion in which the ejected refrigerant and the drawn refrigerant are mixed, the pressure of the mixed refrigerant is increased in the diffuser passage. The nozzle passage 25*a* includes: the smallest passage cross-sectional area portion 25*b* at which the passage cross-sectional area is at the minimum; the convergent portion 25*c* defined on the refrigerant upstream side of the smallest passage cross-sectional area portion 25*b*, the passage cross-sectional area in the convergent portion 25*c* is gradually decreased toward the smallest passage cross-sectional area portion 25*b*; and the divergent portion 25*d* defined on the refrigerant downstream side of the smallest passage cross-sectional area portion 25*b*, the passage cross-sectional area in the divergent portion 25*d* is gradually increased.

Moreover, the refrigerant inflow passages 36*a*, 36*b* that guide the refrigerant from the refrigerant inlet 31*a* to the swirl space 30*a* are defined in the body 30 of the ejector 25, and the ejector 25 includes the area adjustment device 38 that changes the passage cross-sectional area of the refrigerant inflow passage 36*a*, 36*b*.

The other configurations of the ejector-type refrigeration cycle 10*a* are the same as the ejector-type refrigeration cycle 10 of the first embodiment. The ejector 25 of the present embodiment is a device in which multiple components constituting the cycle are integrated with each other. Accordingly, when the ejector-type refrigeration cycle 10*a* of the present embodiment is operated, it works in the same way as the ejector-type refrigeration cycle 10 of the first embodiment, and the same effects can be obtained.

Moreover, in the ejector 25 of the present embodiment, since the swirl space 30*a* that is a swirl flow generation portion, the first refrigerant inflow passage 36*a*, and the second refrigerant inflow passage 36*b* are provided, high energy conversion efficiency can be obtained similarly to the first embodiment by swirling the refrigerant in the swirl space 30*a* during the normal operation of the ejector-type refrigeration cycle 10*a*.

Since the ejector 25 of the present embodiment the thermostat valve 38 that is the area adjustment device, the velocity of the liquid-phase inflow refrigerant flowing into the swirl space 30*a* through the first refrigerant inflow passage 36*a* and the second refrigerant inflow passage 36*b* can be adjusted according to the fluctuation of the load of the ejector-type refrigeration cycle 10*a*.

Accordingly, similarly to the first embodiment, the shape of the air column can be limited from changing largely. Consequently, the ejector that is capable of achieve a high energy conversion efficiency regardless of the fluctuation of the load of the ejector-type refrigeration cycle 10*a* can be provided.

Third Embodiment

In the above-described embodiments, the angular momentum ø0 of the refrigerant flowing into the swirl space is adjusted by the area adjustment device. In the present embodiment, an example is described, in which an appropriate air column is generated in the swirl space regardless of the fluctuation of the load of the ejector-type refrigeration cycle by a geometric shape of a swirl space. The swirl space described in the second embodiment is changed in shape in the present embodiment.

Figure 9:
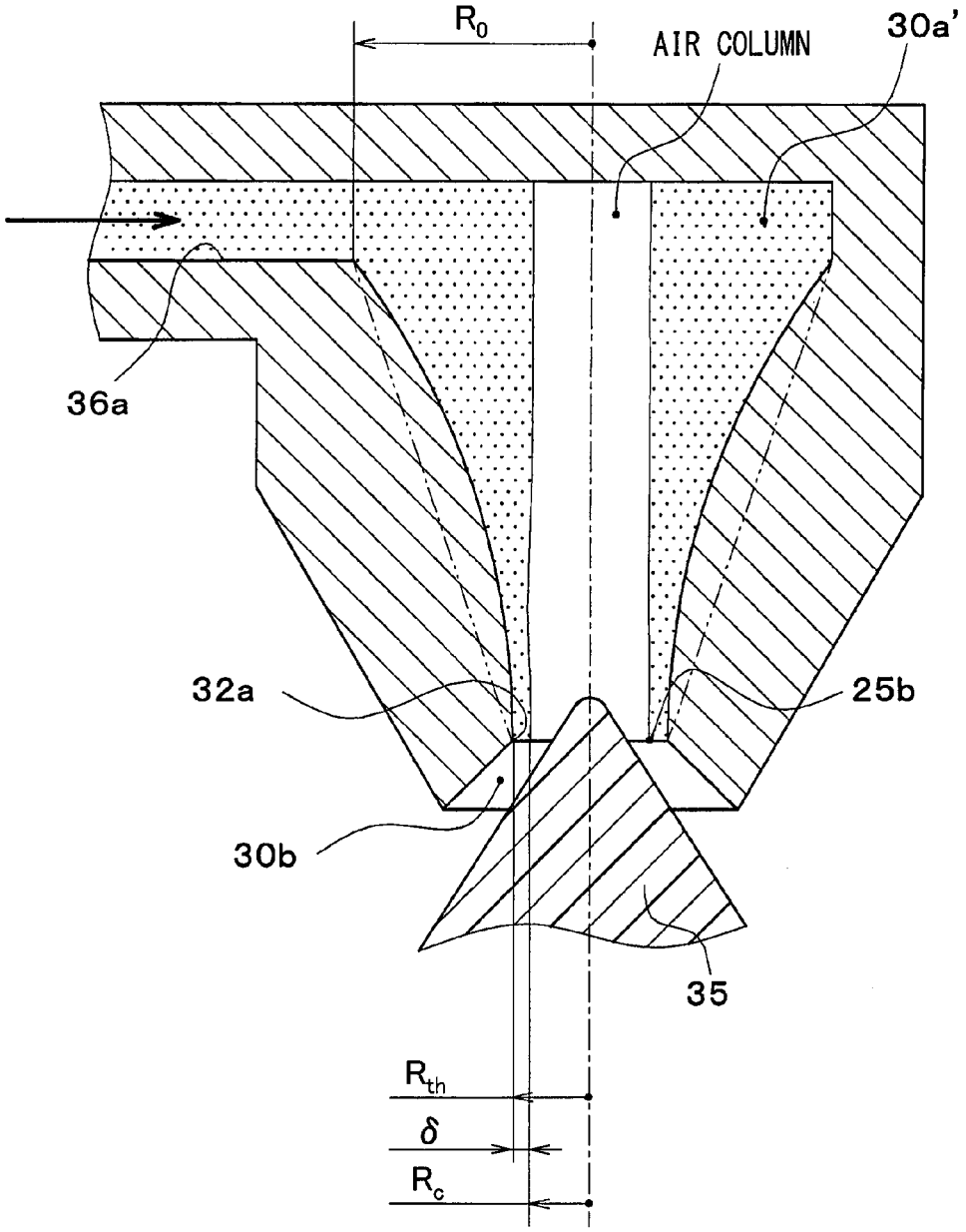
FIG. 9 is a schematic enlarged diagram illustrating a swirl space according to a third embodiment and corresponding to FIG. 8.

In detail, in the present embodiment, the ejector-type refrigeration cycle 10*a* is similar to the second embodiment, and the shape of a swirl space 30*a*' of the ejector 25 is changed, as shown in FIG. 9. FIG. 9 is a schematic enlarged cross-sectional diagram that corresponds to FIG. 8 of the second embodiment. One refrigerant inflow passage 36*a* is provided in the ejector 25 of the present embodiment. Multiple refrigerant inflow passages may be provided similarly to the second embodiment.

Figure 10:
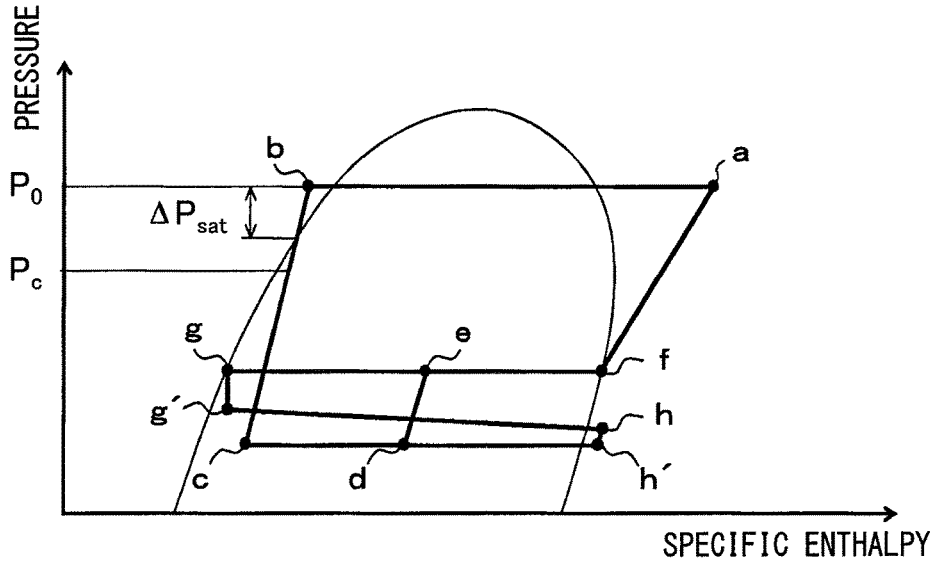
FIG. 10 is a Mollier diagram illustrating a change in a state a refrigerant in an ejector-type refrigeration cycle according to the third embodiment.

When the air column is generated in the swirl space 30*a*', a pressure $P_c$ of a liquid-phase refrigerant on an interface between a gas-phase refrigerant and the liquid phase refrigerant, i.e. the pressure $P_c$ in the air column, is decreased to be less than a saturation pressure, as shown in a Mollier diagram of FIG. 10.

$$P_0-P_c=\Delta P_{sat} \quad \text{(expression 7)}$$

$P_0$ is a pressure of the liquid-phase inflow refrigerant. In FIG. 10, $P_0$, $P_c$, $\Delta P_{sat}$ are added to the Mollier diagram described in the first embodiment. $\Delta P_{sat}$ is decided by physical properties of the refrigerant, and $\Delta P_{sat}$ is a pressure difference between a pressure of the refrigerant flowing into the refrigerant inflow passage 36*a* and a saturation pressure of the refrigerant that is isentropicclly decompressed (decompressed on an isentropic line).

An expression 8 is obtained from the law of conservation of energy.

$$P_{in}+\tfrac{1}{2}\cdot\rho_{in}\cdot v_{\theta in}^2=P_c+\tfrac{1}{2}\cdot\rho_c\cdot v_{\theta c}^2+\tfrac{1}{2}\cdot\rho_c\cdot v_{zc}^2 \quad \text{(expression 8)}$$

Pin is a pressure of the liquid-phase inflow refrigerant right before the refrigerant flows into the swirl space 30*a*' from the refrigerant inflow passage, $\rho_{in}$ is a density of the refrigerant in the refrigerant inflow passage 36*c*, and $v_{in}$ is a velocity of the liquid-phase inflow refrigerant right before the refrigerant flows into the swirl space 30*a*' from the refrigerant inflow passage 36*c*. Accordingly, Pin is equal to the pressure $P_0$ of the inflow liquid-refrigerant, and $v_{in}$ is equal to a swirling speed $v_{\theta 0}$ of the liquid-phase inflow refrigerant.

$P_c$ is a pressure of the air column, $\rho_c$ is a density of the liquid-phase refrigerant on the interface between the gas-phase refrigerant and the liquid-phase refrigerant, $v_{\theta 0}$ is the swirling speed of the liquid-phase refrigerant on the interface between the gas-phase refrigerant and the liquid-phase refrigerant, and $v_{zc}$ is a velocity of the liquid-phase refrigerant on the interface between the gas-phase refrigerant and the liquid-phase refrigerant in an axial direction. Since the liquid-phase refrigerant can be treated as an incompressible fluid as explained by above-described expression 1, $\rho_{in}$ is equal to $\rho_c$ in the above-described expression 8.

Since a thickness δ of a liquid layer at the smallest passage cross-sectional area portion 25*b* is relatively thin, expression 9 is obtained from above-described expression 2 that indicates the law of conservation of angular momentum when δ≈0.

$$R_0 \cdot v_{\theta c} = R_c \cdot v_{\theta c} \approx R_{th} \cdot v_{\theta c} \quad \text{(expression 9)}$$

Expression 10 below can be obtained by substituting expression 9 in expression 8. $R_0$, $R_c$, $R_{th}$ are a radius of swirl of the liquid-phase inflow refrigerant, a radius of the air column, and a radius of swirl of a liquid-phase outflow refrigerant, respectively. Expression 11 can be obtained from expression 7 and expression 10.

$$P_{in} - P_c = \frac{1}{2} \cdot \rho \cdot v_{in}^2 \left\{ \left( \frac{R_0}{R_{th}} \right)^2 - 1 \right\} \quad \text{(expression 10)}$$

$$\frac{R_0}{R_{th}} > \sqrt{\frac{2 \cdot \Delta P_{sat}}{\rho \cdot v_{in}^2} + 1} \quad \text{(expression 11)}$$

When the radius $R_0$ of the swirl of the liquid-phase inflow refrigerant and the radius $R_{th}$ of the swirl of the liquid-phase outflow refrigerant are decided so as to satisfy the above-described expression 11 within a range of the velocity $v_{in}$, the air column can be generated in the swirl space 30*a*' even when the velocity $v_{in}$ of the liquid-phase inflow refrigerant is changed due to the change of the load of the ejector-type refrigeration cycle 10*a*. Therefore, in the present embodiment, the swirl space is shaped such that expression 11 is satisfied.

Specifically, in the present embodiment, a shape that is convex inward compared to a circular cone shape converging downward is employed as the shape of the swirl space 30*a*' that satisfies expression 11. In other words, a shape of the swirl space 30*a*' between an outlet portion of the refrigerant inflow passage 36*a* and a throat portion 32*a* in a cross-section taken in the axial direction is a shape that is convex toward the central axis compared to a straight line (a line having alternate long dashes and pairs of short dashes, in FIG. 9) from the outlet portion of the refrigerant inflow passage 36*a* to the throat portion 32*a*.

According to studies by the inventors, since the swirl space 30*a*' has a shape that is convex toward the central axis as described above, the shape of the air column is not changed largely by the change of the load of the ejector-type refrigeration cycle 10*a* even when the velocity $v_{in}$ of the liquid-phase inflow refrigerant is changed.

Moreover, according to studies by the inventors, when Reynolds number of the refrigerant flowing through the smallest passage cross-sectional area portion 25*b* is Re, and when Re is set to be at or above 10000, the air column can be generated such that the refrigerant flowing into the nozzle passage 25*a* is in appropriate two-phase-separated state regardless of the change of the load of the ejector-type refrigeration cycle 10*a*.

Figure 11:
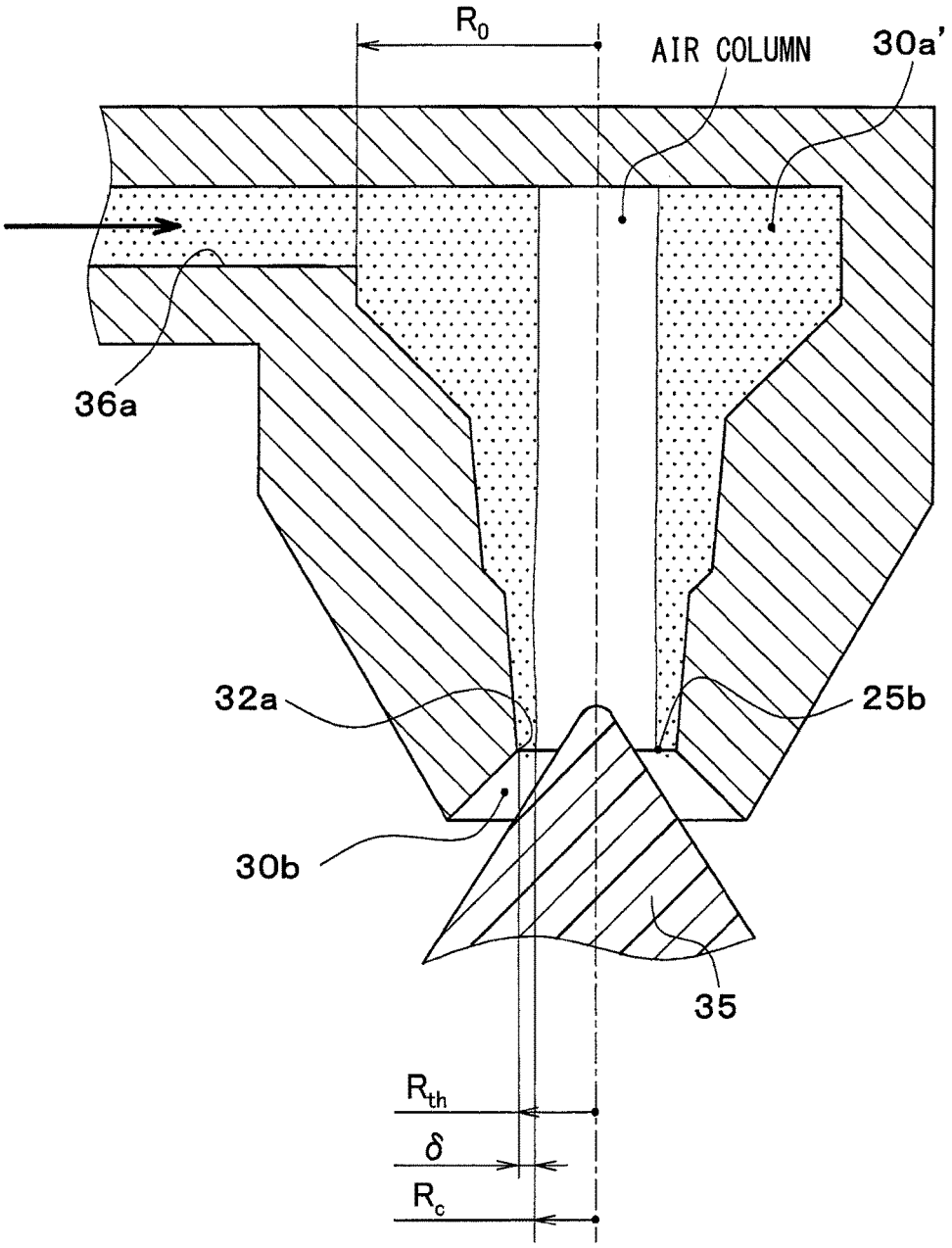
FIG. 11 is a schematic enlarged diagram illustrating a swirl space according to a modification example of the third embodiment and corresponding to FIG. 8.
Figure 12:
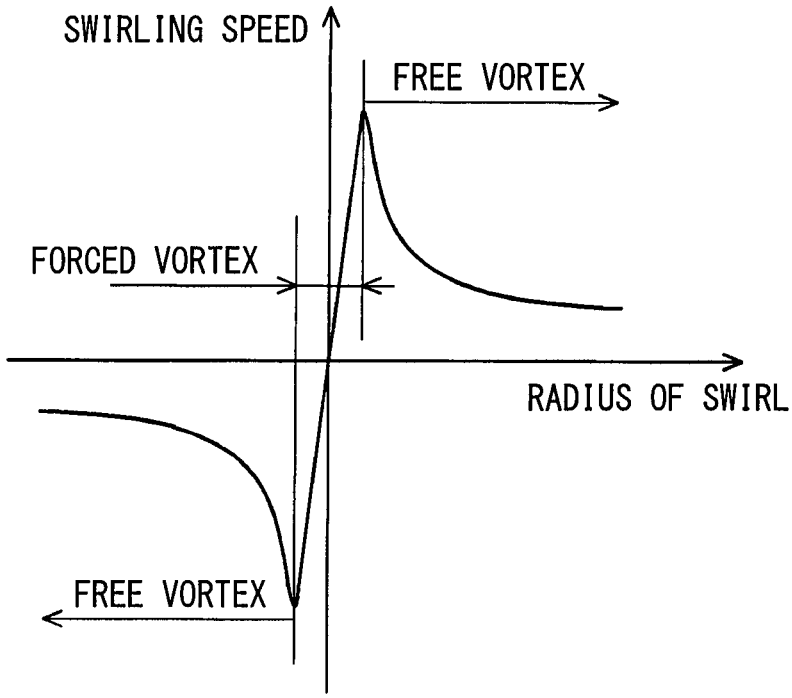
FIG. 12 is a graph illustrating a relationship between a radius of swirl and a swirling speed.

In the present embodiment, an example is described, in which the shape of the swirl space 30*a*' between the outlet portion of the refrigerant inflow passage 36*a* and the throat portion 32*a* is a curved shape. The shape may be a combination of straight lines as shown in FIG. 11, for example, as long as expression 11 is satisfied.

The present disclosure is not limited to the above-described embodiments, and it is to be noted that various changes and modifications will become apparent to those skilled in the art. Configurations described in the above-described embodiments may be combined as long as it is operable.

(1) In the above-described first embodiment, the valve opening degree of the inflow area adjusting valve 24 that is the area adjustment device is increased according to the increase of the radiator outlet side temperature $T_d$. However, the control of the inflow area adjusting valve 24 is not limited to this.

The valve opening degree of the inflow area adjusting valve 24 may be increased according to an increase of the pressure Pd of the refrigerant on the outlet side of the radiator 12, or the valve opening degree of the inflow area adjusting valve 24 may be increased according to an increase of a refrigerant discharge capacity of the compressor 11, as long as the passage cross-sectional area of the refrigerant inflow passage 21*a* is increased according to the increase of the amount of the refrigerant flowing into the swirl space 20*e*.

(2) In the above-described second embodiment, the thermostat valve 38 that is opening-closing device is employed as the area adjustment device, but an opening-closing valve that is actuated by a control voltage outputted from the air conditioning control device 50 may be employed instead of the thermostat valve 38. In this case, when the radiator outlet side temperature $T_d$ is higher than a predetermined reference temperature, an actuation of the opening-closing valve may be controlled such that the distribution refrigerant passage 31*g* is communicated with the inlet side of the second refrigerant inflow passage 36*b*, for example.

In the above-described second embodiment, two refrigerant inflow passages 36*a*, 36*b* are provided, but three or more refrigerant inflow passages may be provided. In this case, the thermostat valve or the opening-closing valve (area adjustment device) is provided between each refrigerant inlet of respective refrigerant inflow passage, and the opening devices (thermostat valve, opening-closing valve) are opened in turn.

(3) The components constituting the ejector-type refrigeration cycle 10 are not limited to the above-described embodiments.

For example, in the above-described embodiments, an electric compressor is used as the compressor 11. However, an engine-driving type compressor which is driven by a rotational driving force transferred from an engine for vehicle travel through a pulley or a belt may be used as the compressor 11. Moreover, as the engine-driving type compressor, a capacity changeable compressor that is capable of changing a refrigerant discharge capacity according to a change of a required discharge amount, or a fixed capacity compressor that adjusts a refrigerant discharge amount by changing an operation rate of the compressor via intermitting an operation of an electromagnetic clutch can be employed.

In the above-described embodiments, a subcooling-type heat exchanger is used as the radiator 12, but an ordinary radiator that includes only the condensing portion 12*a* may be employed. Moreover, a receiver-integrated type condenser in which a liquid receiver (receiver) is integrated with the radiator may be employed. The liquid receiver separates the refrigerant that has dissipated heat in the radiator into a gas-phase refrigerant and a liquid-phase refrigerant and accumulates a surplus liquid-phase refrigerant.

Furthermore, in the above-described embodiment, it is described that R123a, R1234yf or the like can be employed as the refrigerant, but the refrigerant is not limited to this. For example, R600a, R410A, R404A, R32, R1234yfxf, R407C or the like may be employed. Moreover, a mix refrigerant in which some of these refrigerants are mixed may be employed.

(4) In the above-described embodiments, an example where the ejector-type refrigeration cycle 10 according to the present disclosure is used in the vehicular air conditioning device is described, but the usage of the ejector-type refrigeration cycle 10 is not limited to this. For example, the ejector-type refrigeration cycle 10 may be used in a stationary-type air conditioning device, a cooling temperature storage, a cooling-heating device for a vending machine or the like.

(5) In the above-described embodiments, the radiator 12 of the ejector-type refrigeration cycle 10 of the present disclosure is used as an outside heat exchanger that performs heat exchange between the refrigerant and the outside air, and the evaporator 14 is used as a usage side heat exchanger that cools the blown air. However, a heat pump cycle in which: the evaporator 14 may be used as the outside heat exchanger that absorbs heat from a heat source such as an outside air; and the radiator 12 may be used as an interior heat exchanger that heats a heating target fluid such as air or water, can be constituted.

Although the present disclosure has been described in connection with the preferred embodiments thereof, it is to be noted that various changes and modifications will become apparent to those skilled in the art. The present disclosure includes various changes and modifications within the equivalent. Moreover, other combinations and configurations, including more, less or only a single element, are also within the spirit and scope of the present disclosure.

What is claimed is:

1. An ejector for a vapor-compression refrigeration cycle device, the ejector comprising:

a nozzle that ejects a refrigerant;

a swirl flow generation portion that generates a swirl flow about a central axis of the nozzle in the refrigerant flowing into the nozzle;

a body that includes a refrigerant suction port, the refrigerant being drawn from an outside through the refrigerant suction port due to a drawing effect of the ejected refrigerant ejected from the nozzle, and a diffuser portion in which the ejected refrigerant and the drawn refrigerant drawn through the refrigerant suction port are mixed, a pressure of the mixed refrigerant being increased in the diffuser portion;

a passage forming member that is inserted into a refrigerant passage defined in the nozzle;

an actuation device that moves the passage forming member; and an area adjustment device, wherein a nozzle passage is defined between an inner peripheral surface of the nozzle and an outer peripheral surface of the passage forming member, the nozzle passage being a refrigerant passage that decompresses the refrigerant, the nozzle passage includes a smallest passage cross-sectional area portion at which a passage cross-sectional area is at a minimum, a convergent portion that is located upstream of the smallest passage cross-sectional area portion with respect to a refrigerant flow, the passage cross-sectional area in the convergent portion gradually decreasing toward the smallest passage cross-sectional area portion, and a divergent portion that is located downstream of the smallest passage cross-sectional area portion with respect to the refrigerant flow, the passage cross-sectional area in the divergent portion gradually increasing from the smallest passage cross-sectional area portion, the swirl flow generation portion includes a swirl space that has a shape of a solid of revolution and is coaxial with the central axis of the nozzle, and a refrigerant inflow passage through which the refrigerant having a velocity component in a swirl direction flows into the swirl space, and the area adjustment device is configured to change a passage cross-sectional area of the refrigerant inflow passage.

2. The ejector according to claim 1, wherein the area adjustment device is an inflow area adjusting valve that is configured to change the passage cross-sectional area of the refrigerant inflow passage.

3. The ejector according to claim 1 further comprising a plurality of refrigerant inflow passages, wherein the area adjustment device is an opening-closing device configured to close at least a part of the plurality of refrigerant inflow passages.

4. The ejector according to claim 1, wherein the area adjustment device is configured to enlarge the passage cross-sectional area of the refrigerant inflow passage according to an increase of an amount of the refrigerant flowing into the swirl space.

5. The ejector according to claim 1, wherein the area adjustment device is configured to enlarge the passage cross-sectional area of the refrigerant inflow passage according to an increase of a temperature of the refrigerant flowing into the swirl space.

6. An ejector-type refrigeration cycle comprising:

the ejector according to claim 1; and a radiator that cools a high-pressure refrigerant discharged from a compressor compressing the refrigerant such that the high-pressure refrigerant becomes a subcooled liquid-phase refrigerant, wherein the subcooled liquid-phase refrigerant flows into the swirl flow generation portion.

7. An ejector for a vapor-compression refrigeration cycle device, the ejector comprising:

a nozzle that ejects a refrigerant;

a swirl flow generation portion that generates a swirl flow about a central axis of the nozzle in the refrigerant flowing into the nozzle;

a body that includes a refrigerant suction port, the refrigerant being drawn from an outside through the refrigerant suction port due to a drawing effect of the ejected refrigerant ejected from the nozzle, and a diffuser portion in which the ejected refrigerant and the drawn refrigerant drawn through the refrigerant suction port are mixed, a pressure of the mixed refrigerant being increased in the diffuser portion;

a passage forming member that is inserted into a refrigerant passage defined in the nozzle; and an actuation device that moves the passage forming member; wherein a nozzle passage is defined between an inner peripheral surface of the nozzle and an outer peripheral surface of the passage forming member, the nozzle passage being a refrigerant passage that decompresses the refrigerant, the nozzle passage includes a smallest passage cross-sectional area portion at which a passage cross-sectional area is at a minimum, a convergent portion that is located upstream of the smallest passage cross-sectional area portion with respect to a refrigerant flow, the passage cross-sectional area in the convergent portion gradually decreasing toward the smallest passage cross-sectional area portion, and a divergent portion that is located downstream of the smallest passage cross-sectional area portion with respect to the refrigerant flow, the passage cross-sectional area in the divergent portion gradually increasing from the smallest passage cross-sectional area portion, the swirl flow generation portion includes a swirl space that has a shape of a solid of revolution and is coaxial with the central axis of the nozzle, and a refrigerant inflow passage through which the refrigerant having a velocity component in a swirl direction flows into the swirl space, $v_{in}$ is a velocity of the refrigerant flowing into the swirl space from the refrigerant inflow passage, $R_0$ is a radius of a swirl of the refrigerant flowing into the swirl space from the refrigerant inflow passage, $R_{th}$ is a radius of a swirl of the refrigerant at the smallest passage cross-sectional area portion, ρ is a density of the refrigerant in liquid-phase, $\Delta P_{sat}$ is a pressure difference between a pressure of the refrigerant flowing into the refrigerant inflow passage and a saturation pressure at which the refrigerant is saturated when the refrigerant is decompressed isentropically, and $$\frac{R_0}{R_{th}} > \sqrt{\frac{2 \cdot \Delta P_{sat}}{\rho \cdot v_{in}^2} + 1}\,.$$

8. The ejector according to claim 7, wherein

Re is a Reynolds number of the refrigerant flowing through the smallest passage cross-sectional area portion, and Re>10000.

9. An ejector-type refrigeration cycle comprising:

the ejector according to claim 7, and a radiator that cools a high-pressure refrigerant discharged from a compressor compressing the refrigerant such that the high-pressure refrigerant becomes a subcooled liquid-phase refrigerant, wherein the subcooled liquid-phase refrigerant flows into the swirl flow generation portion.

* * * * *